US008474227B2

(12) United States Patent
Irwin

(10) Patent No.: US 8,474,227 B2
(45) Date of Patent: Jul. 2, 2013

(54) BAG ACCUMULATING DEVICE, BAG NECK GATHERING MACHINE, AND METHOD

(76) Inventor: Jere F. Irwin, Yakima, WA (US)

( * ) Notice: Subject to any disclaimer, the term of this patent is extended or adjusted under 35 U.S.C. 154(b) by 651 days.

(21) Appl. No.: 10/835,327

(22) Filed: Apr. 28, 2004

(65) Prior Publication Data

US 2005/0241275 A1 Nov. 3, 2005

(51) Int. Cl.
*B65B 51/04* (2006.01)

(52) U.S. Cl.
USPC ..... 53/417; 53/138.2; 53/138.7; 53/370.2; 53/414; 53/483; 53/583

(58) Field of Classification Search
USPC ..... 53/138.8, 139.9, 414, 417, 483, 583, 53/370.2, 370.5, 284.7, 469, 480, 481, 372.4, 53/482, 373.2, 375.4, 472.4, 473.2; 198/579, 198/575, 577, 604, 608, 620, 623, 626.1
See application file for complete search history.

(56) References Cited

U.S. PATENT DOCUMENTS

| | | | | | |
|---|---|---|---|---|---|
| 2,698,659 | A | * | 1/1955 | Kosek | 226/10 |
| 3,163,969 | A | | 1/1965 | Irwin et al. | 53/14 |
| 3,163,972 | A | | 1/1965 | Irwin | 53/138 |
| 3,648,432 | A | * | 3/1972 | Zellmer et al. | 53/138.8 |
| 3,740,921 | A | * | 6/1973 | Meyer | 53/512 |
| 3,779,367 | A | * | 12/1973 | Hope et al. | 198/592 |
| 3,783,585 | A | * | 1/1974 | Hoyland | 53/583 |
| 3,861,123 | A | * | 1/1975 | Eburn et al. | 53/370.5 |
| 3,919,829 | A | * | 11/1975 | Burford et al. | 53/138.8 |
| 3,983,681 | A | * | 10/1976 | Britt et al. | 53/76 |
| 4,005,563 | A | * | 2/1977 | Nitsch | 53/138.8 |
| 4,069,646 | A | * | 1/1978 | Slomp et al. | 53/138.5 |
| 4,111,733 | A | * | 9/1978 | Periers | 156/204 |
| 4,534,149 | A | * | 8/1985 | Hoyland | 53/76 |
| 4,621,479 | A | * | 11/1986 | Hoyland | 53/133.3 |
| 4,913,415 | A | * | 4/1990 | Weber | 271/272 |
| 5,040,355 | A | * | 8/1991 | Tirelli | 53/417 |
| 5,184,447 | A | * | 2/1993 | Johnsen | 53/373.9 |
| 5,239,809 | A | * | 8/1993 | Long | 53/513 |
| 5,465,549 | A | * | 11/1995 | Lummus | 53/138.8 |
| 5,503,547 | A | * | 4/1996 | Funahashi et al. | 425/336 |
| 5,708,339 | A | * | 1/1998 | Frazier et al. | 318/468 |

OTHER PUBLICATIONS

U.S. Appl. No. 60/480,144, filed Jun. 20, 2003, Irwin.
U.S. Appl. No. 60/480,339, filed Jun. 19, 2003, Irwin.

* cited by examiner

*Primary Examiner* — Hemant M Desai
*Assistant Examiner* — Gloria R Weeks
(74) *Attorney, Agent, or Firm* — Wells St. John P.S.

(57) ABSTRACT

A bag accumulating device is provided with a first drive mechanism and a second drive mechanism. The first drive mechanism is configured to advance an open-mouth portion of a bag at a first speed. The second drive mechanism is provided adjacent and downstream of the first drive mechanism. The second drive mechanism is configured to advance the open-mouth portion of the bag at a second speed that is less than the first speed so as to accumulate and foreshorten the open-mouth portion of the bag. A method is also provided.

27 Claims, 18 Drawing Sheets

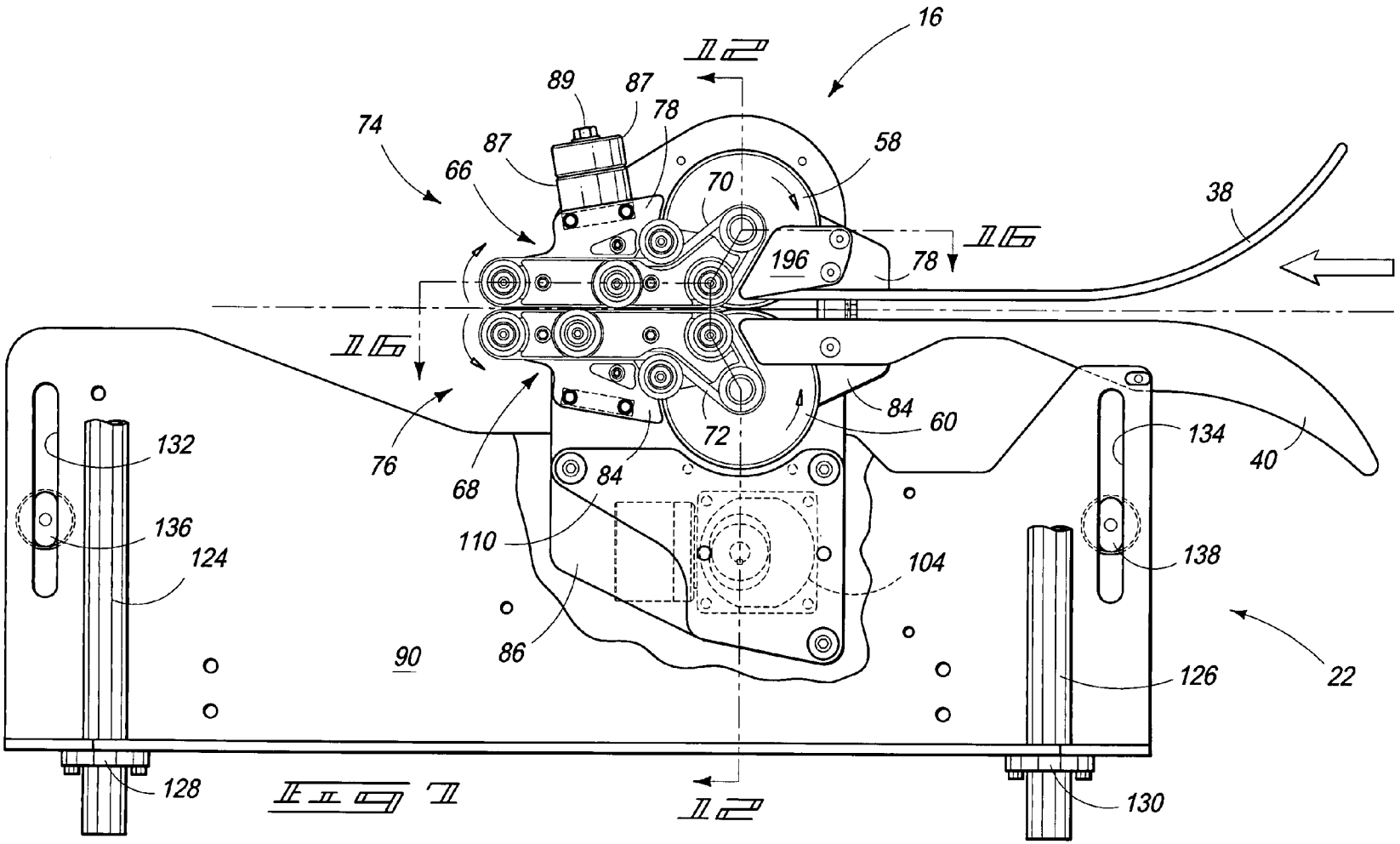
16
22
38
40
58
60
66
68
70
72
74
76
78
84
86
87
89
90
104
110
124
126
128
130
132
134
136
138
196
II
II
II
II
II
II 16
42
92
89
87
87
80
264
276
70
150
82
78
84
98
96
266
102
268
278
86
160
72
88
272
94
300
302
310
308
304
44
270
306
104
284
90

38
130
258
92
104
100
264
258
88
80
42
16
78
90
128
90

62
58
286
312
70
144
100
202
203
116
209
286
296
146
165
66
88
140
78
164
211
205
314
70
150

BAG ACCUMULATING DEVICE, BAG NECK GATHERING MACHINE, AND METHOD

TECHNICAL FIELD

This invention pertains to article bagging systems and methods. More particularly, the present invention relates to machines and methods for preparing a plastic bag to receive a closure device about the neck of the bag after the bag has been filled with one or more items, such as a stack of thermoformed articles.

BACKGROUND OF THE INVENTION

Previous machines are known for preparing and applying clips onto the neck of a plastic bag. For example, U.S. Pat. Nos. 3,163,969 and 3,163,972 disclose methods and apparatus for applying bag closures, or clips, onto the open neck portion of a plastic bag inside of which articles have previously been inserted. In the process of designing thermoforming lines and bagging machines for thermoformed articles, it has been realized that improvements are now needed in the design of bag closing machines in order to more accurately, quickly, and repeatedly apply clips onto plastic bags that contain articles.

More particularly, present bag closing machines oftentimes do not properly or completely apply a clip onto an open neck portion of a polyethylene plastic bag. As the operating speeds of thermoforming machines and bagging machines have increased, this problem has been exacerbated as the increased speeds frequently lead to an increase in misapplied clips to bags.

Accordingly, improvements are needed in the manner in which an open neck of a plastic bag is delivered, presented and prepared for delivery into a bag closing machine, where a clip is applied onto the open neck portion of the bag to close the bag.

SUMMARY OF THE INVENTION

A bag accumulating apparatus and method is provided for processing and preparing an open neck portion of a bag so as to bunch up the neck of the bag before the neck is delivered into a bag closing machine where a clip is subsequently applied. In one case, the bag is a polyethylene plastic bag.

According to one aspect, a bag accumulating device is provided with a first drive mechanism and a second drive mechanism. The first drive mechanism is configured to advance an open-mouth portion of a bag at a first speed. The second drive mechanism is provided adjacent and downstream of the first drive mechanism. The second drive mechanism is configured to advance the open-mouth portion of the bag at a second speed that is less than the first speed so as to accumulate and foreshorten the open-mouth portion of the bag.

According to another aspect, a bag neck gathering machine includes a pair of co-acting, rotating feed wheels and a pair of co-acting, rotating endless bands. The pair of co-acting, rotating feed wheels is configured to move an open neck of a plastic bag along a travel path at a first speed. The pair of co-acting, rotating endless bands is provided adjacent and downstream of the feed wheels in order to move the open neck of the plastic bag along the travel path at a second speed. The second speed is below that of the first speed so that the neck of the plastic bag is bunched up between the pair of bands for subsequent delivery into a bag closing machine.

According to even another aspect, a bag neck gathering machine is provided having first means and second means. The first means are provided for moving an open neck portion of a bag at a first rate. The second means are provided proximate and downstream of the first means. The second means move the open neck portion of the bag at a second rate less than the first rate to gather together at least in part the open neck portion of the bag.

According to yet even another aspect, a method is provided for bunching an open mouth of a plastic bag. The method includes: providing a first feed mechanism and a second feed mechanism downstream and adjacent to the first feed mechanism; delivering an open neck portion of a bag into the first feed mechanism; moving the open neck portion of the bag through the first feed mechanism at a first velocity; receiving the open neck portion of the bag from the first feed mechanism into the second feed mechanism; and accumulating the open neck portion of the bag in the second feed mechanism by moving the second feed mechanism at a second velocity below the velocity of the first feed mechanism to bunch up the open neck portion of the bag.

According to yet another aspect, a method is provided for gathering together an open neck portion of a bag. The method includes: providing a first feed mechanism and a second feed mechanism downstream of the first feed mechanism; moving an open neck portion of a bag through the first feed mechanism at a first velocity and into the second feed mechanism at a second velocity; and accumulating the open neck portion of the bag within the second feed mechanism at the second velocity.

BRIEF DESCRIPTION OF THE DRAWINGS

Preferred embodiments of the invention are described below with reference to the following accompanying drawings.

FIG. 4 is a plan view corresponding with the partial perspective view of FIG. 1 and illustrating a bag containing articles being progressively moved later in time than that depicted in FIG. 3 with the open neck of the bag being bunched together by the bag accumulating device.

FIG. 7 is a vertical partial frontal view illustrating the bag accumulating device of FIGS. 1-6 taken transverse to the direction along which bags and articles are conveyed through the bag fastening system.

FIG. 8 is an enlarged partial view, with portions omitted, of the drive mechanisms for the bag accumulating device of FIG. 7.

FIG. 10 is an enlarged perspective view of a sidewall member for the top track assembly of FIG. 9.

FIG. 16 is a partial sectional view taken along line 16-16 of FIG. 7 and further illustrating construction of the bag accumulating device.

FIG. 17 is an enlarged partial sectional view taken from the arrow source of FIG. 16 and further illustrating construction of the bag accumulating device.

FIG. 18 is an enlarged partial view, with portions omitted, of an alternatively constructed drive mechanism for the bag accumulating device of FIG. 7.

DETAILED DESCRIPTION OF THE PREFERRED EMBODIMENTS

This disclosure of the invention is submitted in furtherance of the constitutional purposes of the U.S. Patent Laws "to promote the progress of science and useful arts" (Article 1, Section 8).

Reference will now be made to a preferred embodiment of Applicant's invention. More particularly, a bag accumulating device is provided for use within a bag fastening system to improve the ease, effectiveness, and speed with which a bag fastening system is capable of operating. While the invention is described by way of a preferred embodiment, it is understood that the description is not intended to limit the invention to such embodiments, but is intended to cover alternatives, equivalents, and modifications which may be broader than the embodiments, but which are included within the scope of the appended claims.

In an effort to prevent obscuring the invention at hand, only details germane to implementing the invention will be described in great detail, with presently understood peripheral details being incorporated by reference, as needed, as being presently understood in the art.

Figure 1:
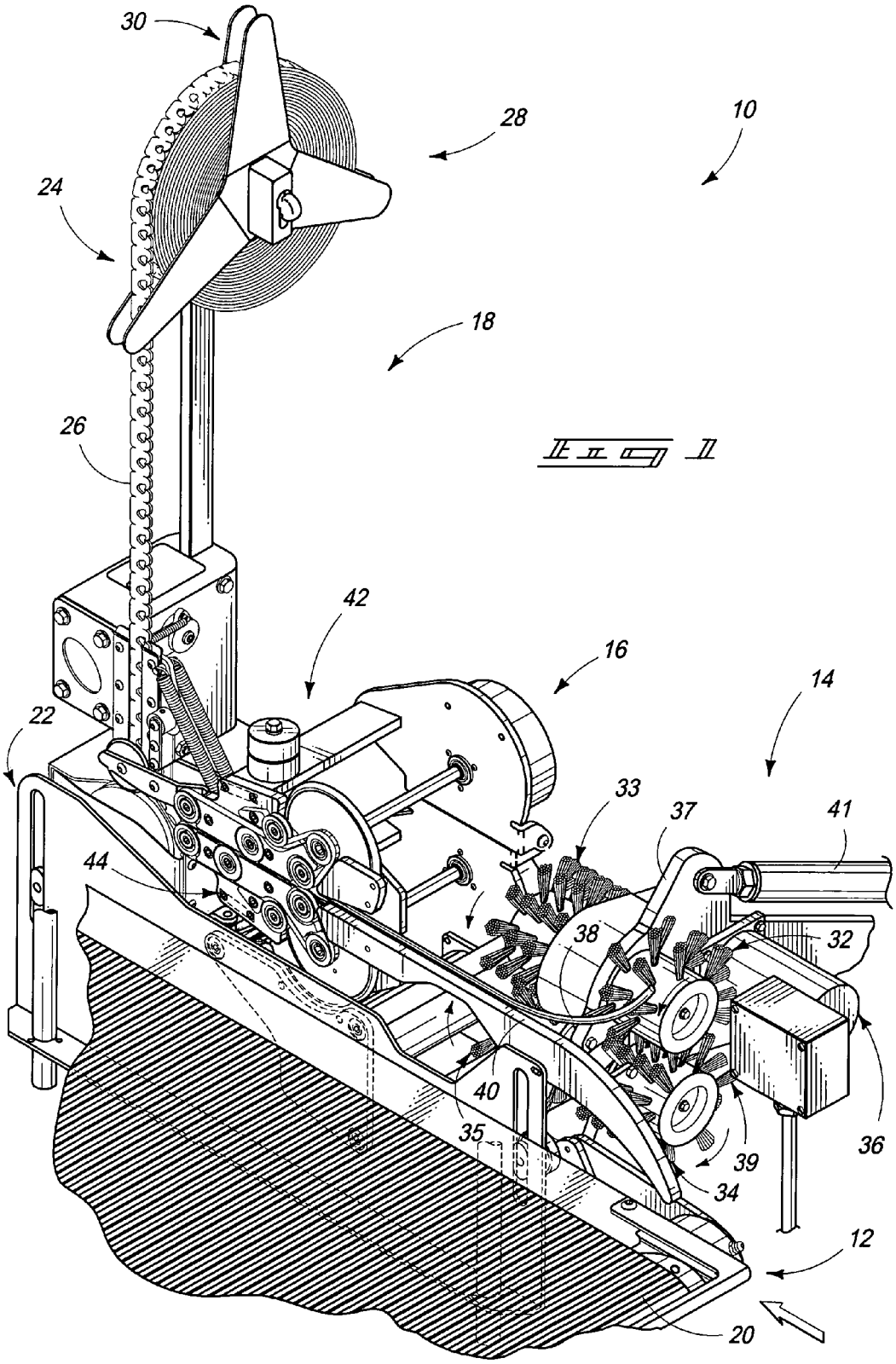
FIG. 1 is a simplified partial perspective view of a bag fastening system with a conveyor table, a bag arranging device, a bag accumulating device, and a bag closing device, and particularly emphasizing features of the bag accumulating device according to one aspect of the present invention.

FIG. 1 illustrates a bag fastening system 10 that incorporates novel features of the present invention as claimed herein. Bag fastening system 10 includes a substantially horizontal conveyor table 12 configured and arranged to support a bag arranging device 14, a bag accumulating device 16, and a bag closing device 18. Devices 14, 16, and 18 are mounted side-by-side along one edge of a conveyor belt 20. Conveyor belt 20 moves article-filled bags such that an open neck portion of each bag is disposed towards devices 14, 16, and 18. More particularly, bags of articles are conveyed along conveyor belt 20 from an upstream direction adjacent device 14 and toward a downstream direction adjacent device 18. In the process, bag arranging device 14 flattens and aligns the open neck portion of each bag. Bag accumulating device 16 then bunches up the open neck portion to reduce width of the open neck portion as the bunched-up open neck portion is then conveyed into bag closing device 18. The bunched-up open neck portion is then delivered into a closure aperture of a clip (or closure) on bag closing device 18 which is attached to and subsequently severed from a string of clips. The entire operation is performed sequentially as a bag of articles is conveyed in a downstream direction by conveyor belt 20.

As shown in FIG. 1, a table elevator mounting assembly 22 is provided on a side edge of conveyor table 12 for adjusting in unison the elevation of bag arranging device 14, bag accumulating device 16, and bag closing device 18. Accordingly, the horizontal plane in which an open neck (or mouth) portion of a bag is horizontally flattened via device 14, bunched up via device 16, and closed via device 18 can be adjusted relative to the horizontal plane of conveyor belt 20. Such adjustment may be desirable when the thickness of an article (or stack of articles) that is loaded into a bag is changed. For example, one condition may require the bagging of a stack of 25 thermoformed plates into a polyethylene plastic bag, whereas a second operation may require the bagging of 50 plates. Hence, the optimal elevational position for horizontally flattening, bunching, and closing an open neck portion of a bag can be optimally adjusted by raising or lowering devices 14, 16, and 18 to a desired elevation relative to the plane of conveyor belt 20.

As shown in FIG. 1, an array (or strip) 24 of individual clips (or closures) 26 are stored as a roll 28 on a reel assembly 30 of bag closing device 18. Bag closing device 18 severs individual clips 26 from strip 24 by cutting individual clips 26 from strip 24 after a bunched, open neck portion of a plastic bag is accumulated inside clip 26. Optionally, a bag closing device as taught in U.S. Pat. Nos. 3,163,969 and 3,163,972 can be used in place of bag closing device 18 to apply clips to a bag neck by bending and snapping off individual clips. U.S. Pat. Nos. 3,163,969 and 3,163,972 are herein incorporated by reference to illustrate construction and operation of such devices.

According to FIG. 1, bag arranging device 14 is provided upstream of bag accumulating device 16 in order to flatten and smooth out an open neck portion of a plastic bag to prepare the bag to be advanced into bag accumulating device 16. In operation, bag arranging device 14 cooperates with a pair of guide bars 38 and 40 of bag accumulating device 16 to guide, flatten, and smooth out the open neck portion of a bag in which articles have been previously deposited. More particularly, two sets of brushes 32, 34 and 33, 35 each cooperate in counter-rotation to draw the open neck portion of the bag into and between the two sets of brushes. The open neck is drawn between the sets of brushes 32, 34 and 33, 35 until a stack of articles within the bag is engaged against guides 38 and 40 such that the articles are driven into the bottom of the bag and the free edge of the bag is further drawn in between the sets of brushes 32, 34 and 33, 35. In this manner, it is ensured that articles within a plastic bag are driven to the bottom of the bag and the open neck portion of the bag becomes free and is straightened out and smoothed over between the respective pairs of counter-rotating brushes.

More particularly, an alternating current (AC) motor 36 is configured to drive cylindrical brushes 32 and 33 in one direction, about a common axis, while driving brushes 34 and 35 in an opposite, counter-rotating direction along a second, common axis. Brushes 32, 34 and 33, 35 are driven so as to provide an entrance nip between the brushes on a side adjacent to guides 38 and 40. Accordingly, an open neck portion of a plastic bag is drawn in between brushes 32 and 34 until contents (such as articles) within the bag engage against guide bars 38 and 40, which, forces the contents to the bottom of the bag and draws a resulting free portion of the open neck portion between the brushes where such open neck portion is flattened and generally smoothed out for presentment into bag accumulating device 16. According to one implementation, brushes 32, 34 and 33, 35 are rotated in opposite directions at 450 revolutions per minute (RPM). Other operating speeds are also possible.

As shown in FIG. 1, bag arranging device 14 includes an upper frame 37 that is pivotally supported by a lower frame 39 via a hinge having a pivot axis. Upper frame 37 is held in a desired pivoted position relative to lower frame 39 using a length-adjustable threaded rod support 41 that adjusts and fixes the pivotal positioning of upper frame 37 relative to lower frame 39 by modifying the length of rod support 41 via station of a threaded rod within a nut at each end. As a result, the distances between brushes 32, 34 and 33, 35 can be adjusted which can help enhance performance when bag properties and operating speeds are changed. Motor 36 has a drive shaft with a chain sprocket that drives a chain. The chain drives a sprocket in the upper frame in a first direction, and the chain is twisted a half turn to drive a sprocket in the lower frame in a second, opposite direction. An idler sprocket guides the twisted chain and is spring biased to tension the chain.

According to one construction, brushes 32 and 33 are driven by a common shaft having a chain sprocket that is driven by a drive chain. Likewise, brushes 34 and 35 are driven by a similar chain sprocket via the chain, which has a half-turn twist that drives brushes 34 and 35 in counter-rotation relative to brushes 32 and 33 with the help of an idler sprocket. Brushes 32-35 are each formed from groups of flexible synthetic plastic bristles.

According to one construction, brushes 32 and 35 have relatively stiff bristles, whereas brushes 33 and 34 have relatively soft bristles. One suitable relatively stiff bristle is a black Type 6.6 nylon crimped bristle with a 0.010-inch diameter. One suitable relatively soft bristle is a black Type 6.6 nylon crimped bristle with a 0.006-inch diameter. These brushes are sold by Carolina Brush Company, of Gastonia, N.C.

It has been discovered that counter-rotation of stiff bristles 32 against relatively soft bristles 34 imparts flexing of bristles 34 which tends to grab and flatten out the top section of an open neck portion on a plastic bag, whereas relatively stiff bristles 35 tend to co-act and flex against relatively soft bristles 33 so as to more effectively grab and flatten a bottom section of an open neck portion on a plastic bag. Hence, bag arranging device 14 more effectively flattens and smooths out an open neck portion of a plastic bag by initially more effectively gripping the upper section of the open neck portion and subsequently more effectively gripping the lower section of the open neck portion Typically, adjustment rod 41 is adjusted in axial length for a specific bag construction, such as a bag having a desired plastic material and thickness. One typical adjustment causes brushes 32, 34 and 33, 35 to have a slight interference fit such that the relatively stiff bristles tend to flex the relatively soft bristles to a greater degree than the stiff bristles as the respective brushes co-act on opposite sides of an open neck portion of a plastic bag.

According to one implementation, bag fastening system 10 is designed to be used downstream of a bagging machine that receives stacks of articles from a thermoforming line. For example, plates formed from thermoformable plastic foam sheet material are delivered from a thermoforming line in stacks of a pre-selected quantity. The stacks of plates are then conveyed onto a bagging machine where they are delivered into a folded film of material, after which bags are formed from the film about the stacks of plates. The bagged plates are then delivered into a bag fastening system 10 (see FIG. 1) where the open neck portions of the bags are arranged, accumulated, and then closed with a bag closure or clip. One suitable construction for a bagging machine is disclosed in U.S. Provisional Patent Application Ser. No. 60/480,144, entitled "Heat Seal Apparatus and Bagging Machine", listing the inventor as Jere F. Irwin and filed on Jun. 20, 2003. Another suitable construction is disclosed in U.S. Provisional Patent Application Ser. No. 60/480,339, entitled "Heat Seal Apparatus and Bagging Machine", listing the inventor as Jere F. Irwin, and filed Jun. 19, 2003. Both of the above U.S. Provisional Patent Application Ser. Nos. 60/480,144 and 60/480,339 are herein incorporated by reference.

Figure 2:
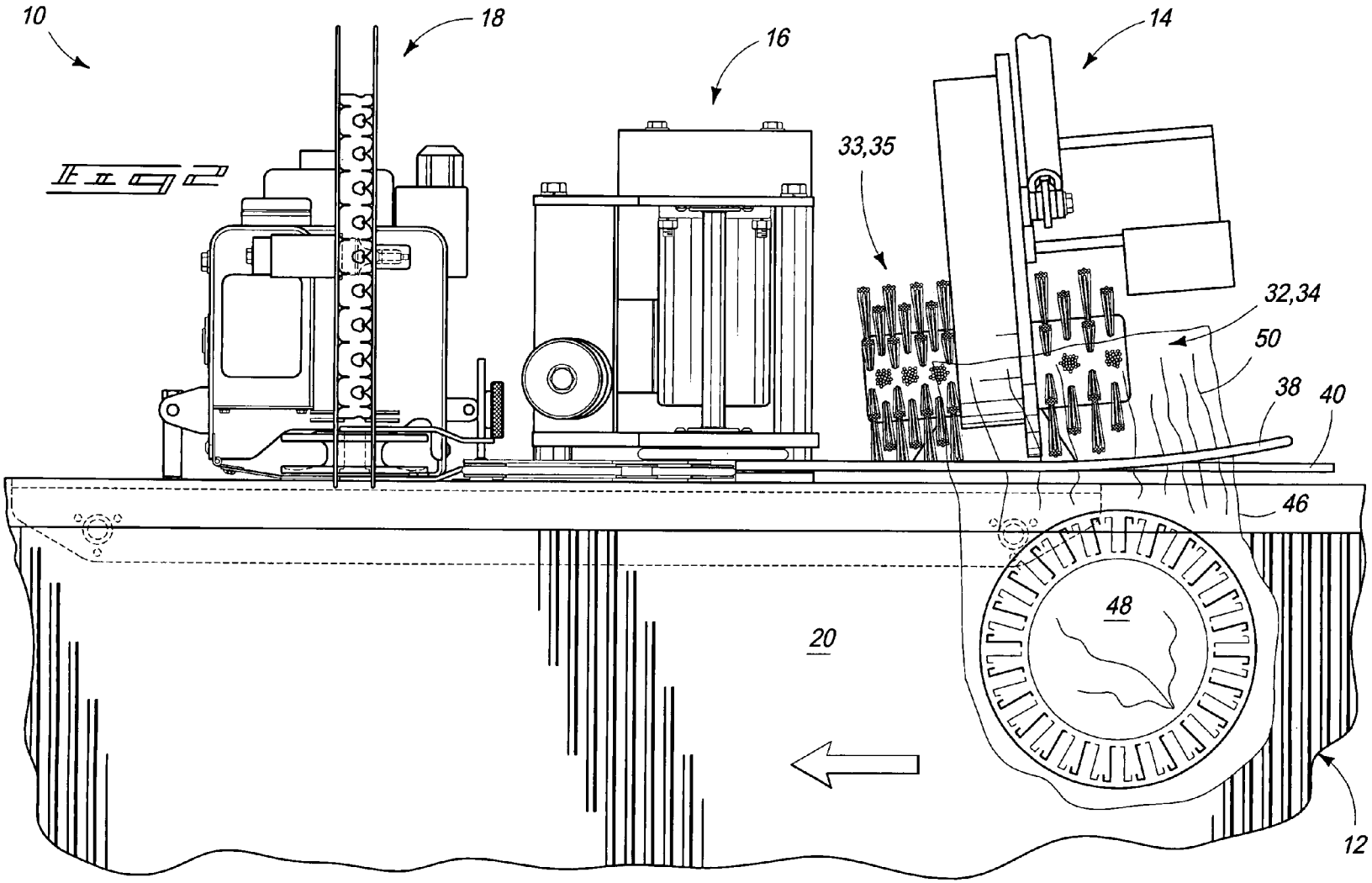
FIG. 2 is a plan view corresponding with the partial perspective view of FIG. 1 and further illustrating a bag containing articles and being progressively moved into a bag arranging device of the bag fastening system of FIG. 1.

FIGS. 2-5 illustrate progressively in time the advancement of a plastic bag 46 and a stack of articles (e.g., thermoformed plates) 48 through a bag fastening system 10. As shown in FIG. 2, a bag 46 of stacked articles 48 is received from a bagging machine onto conveyor table 12. Bag 46 and articles 48 are conveyed along conveyor belt 20 in a downstream direction with an open neck portion 50, of bag 46 oriented toward devices 14, 16, and 18. More particularly, bag 46 is deposited onto belt 20 so as to convey open neck portion 50 between upper guide bar 38 and lower guide bar 40 of device 16.

Guide bars 38 and 40 extend laterally upstream a sufficient distance so as to provide guidance of neck portion 50 into bag arranging device 14. Guide bars 38 and 40 diverge in an upstream direction to ensure capture of the open neck portions 50 of bags 46. Guide bars 38 and 40 cooperate to guide and orient open neck portion 50 for passage between pairs of counter-rotating brushes 32, 34 and 33, 35. Co-action between brushes 32, 34 and brushes 33, 35 serves to pull open neck portion 50 into and between the respective pairs of brushes, which draws bag 46 toward device 14 until stack of articles 48 engages against guide bars 38 and 40. As articles 48 engage against guide bars 38 and 40, articles 48 are driven into the bottom of bag 46 which provides for an increased (or maximized) amount of free material, thereby lengthening open neck portion 50. Accordingly, an additional length of open neck portion 50 is drawn between brushes 32, 34 and 33, 35 as articles 48 are driven to the bottom of bag 46.

As shown in FIG. 2, bag arranging device 14 is supported about a pivot point for pivotal positioning in a horizontal plane so that the orientation of brushes 32, 34 and 33, 35 can be rotated to be parallel with a side edge on table 12 or they can be rotated to form an acute skew angle with the side of table 12 either on an upstream side, or on a downstream side. Such adjustments in positioning are desirable based upon the specific type of bag and thickness of bag being presented into device 14.

According to one implementation, bag 46 comprises a clear polyethylene plastic bag. However, it is possible that other types of bags can be processed through bag fastening system 10 including Mylar® bags, paper bags, and woven bags, including cloth bags. Mylar® is commercially available from E.I. Du Pont De Nemours and Company, of Wilmington, Del.

Figure 3:
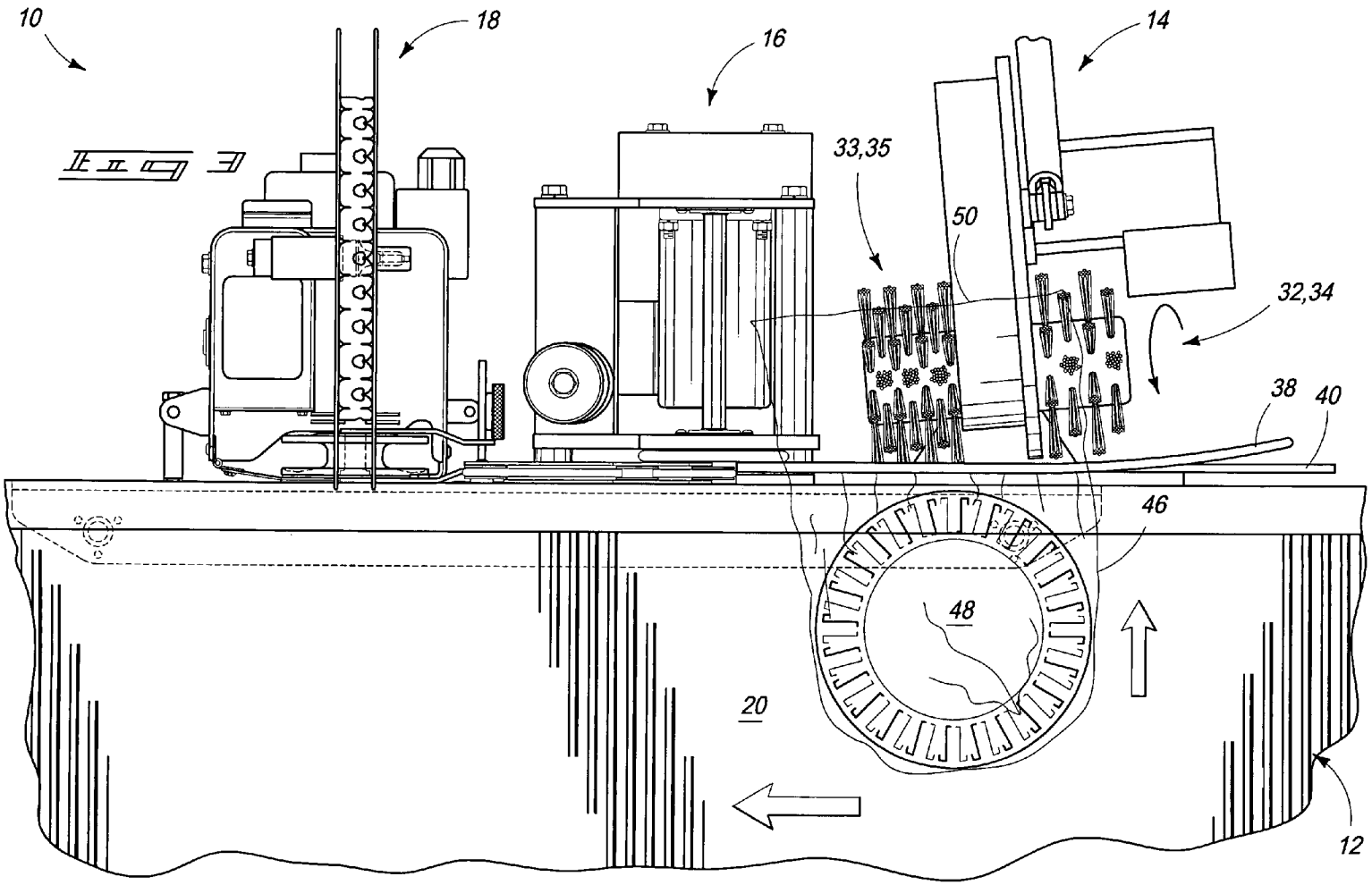
FIG. 3 is a plan view corresponding with the partial perspective view of FIG. 1 and illustrating a bag with articles being arranged by the bag arranging device of the bag fastening system of FIG. 1, and later in time than that depicted in FIG. 2.
Figure 3:
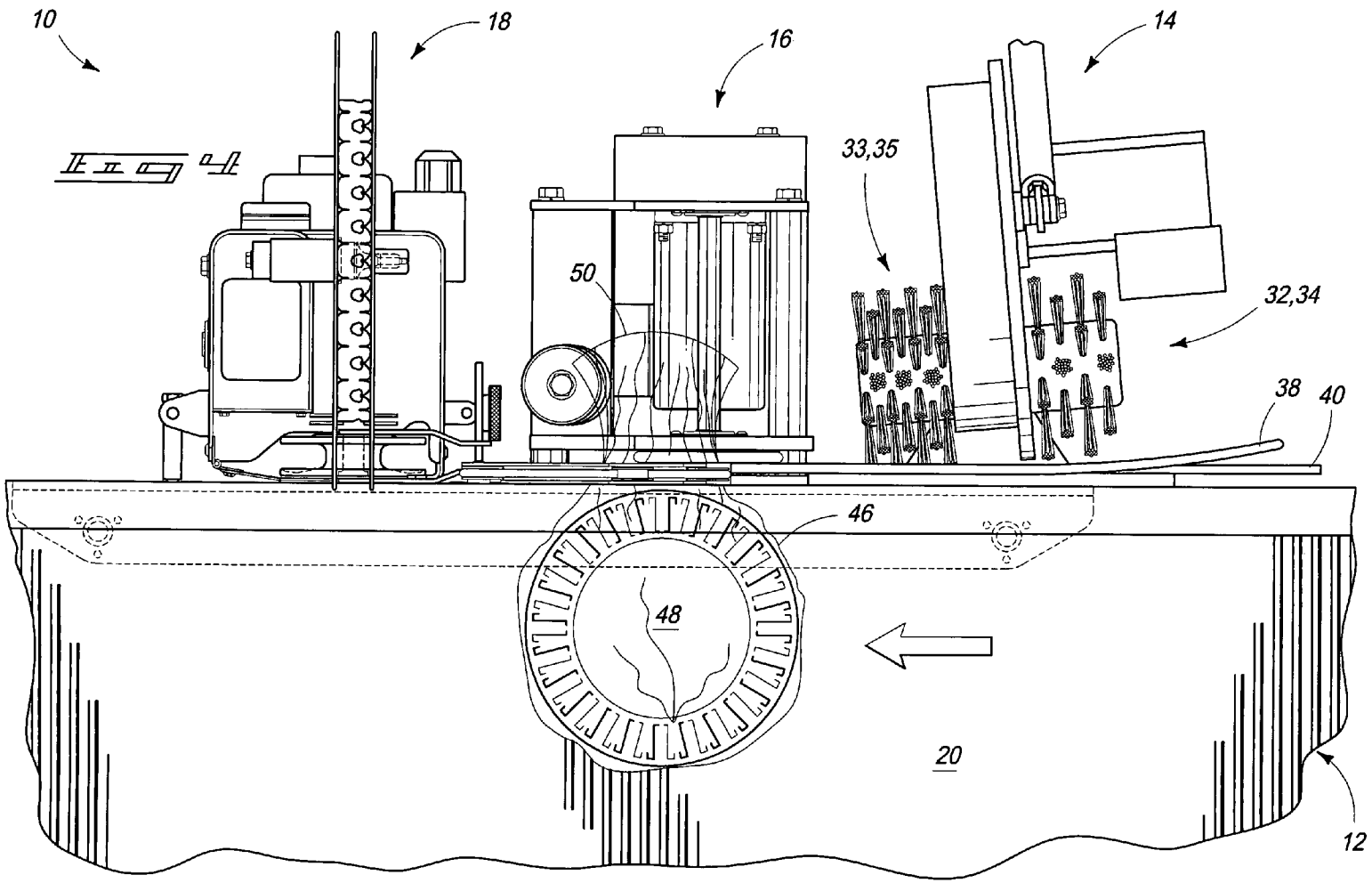

FIG. 3 illustrates bag fastening system 10 subsequent in time to that depicted in FIG. 1 as bag 46 and articles 48 are delivered downstream, and after open neck portion 50 has been drawn into and between brushes 32, 34 as well as between brushes 33, 35. Open neck portion 50 is straightened and smoothed out as it passes between the respective pairs of brushes 32, 34 and 33, 35. Additionally, articles 48 are driven into the bottom of bag 46 which frees up and lengthens open neck portion 50 for further processing and straightening between the respective counter-rotating brushes.

FIG. 4 illustrates bag fastening system 10 even later in time than depicted in FIG. 3. More particularly, bag 46 and articles 48 are moved further downstream where they are delivered into bag accumulating device 16 by way of guide bars 38, 40 and motion of belt 20. Bag accumulating device 16 receives the flattened and smoothed out open neck portion 50 of bag 46 where the open neck portion is bunched up (or accumulated) to reduce the width of the open neck portion in a direction substantially parallel to the direction of travel of belt 20. By bunching up open neck portion 50, bag closing device 18 can more efficiently, effectively, and quickly apply clips onto bunched-up open neck portion 50 in a subsequent operation identified below with respect to FIG. 5.

Figure 5:
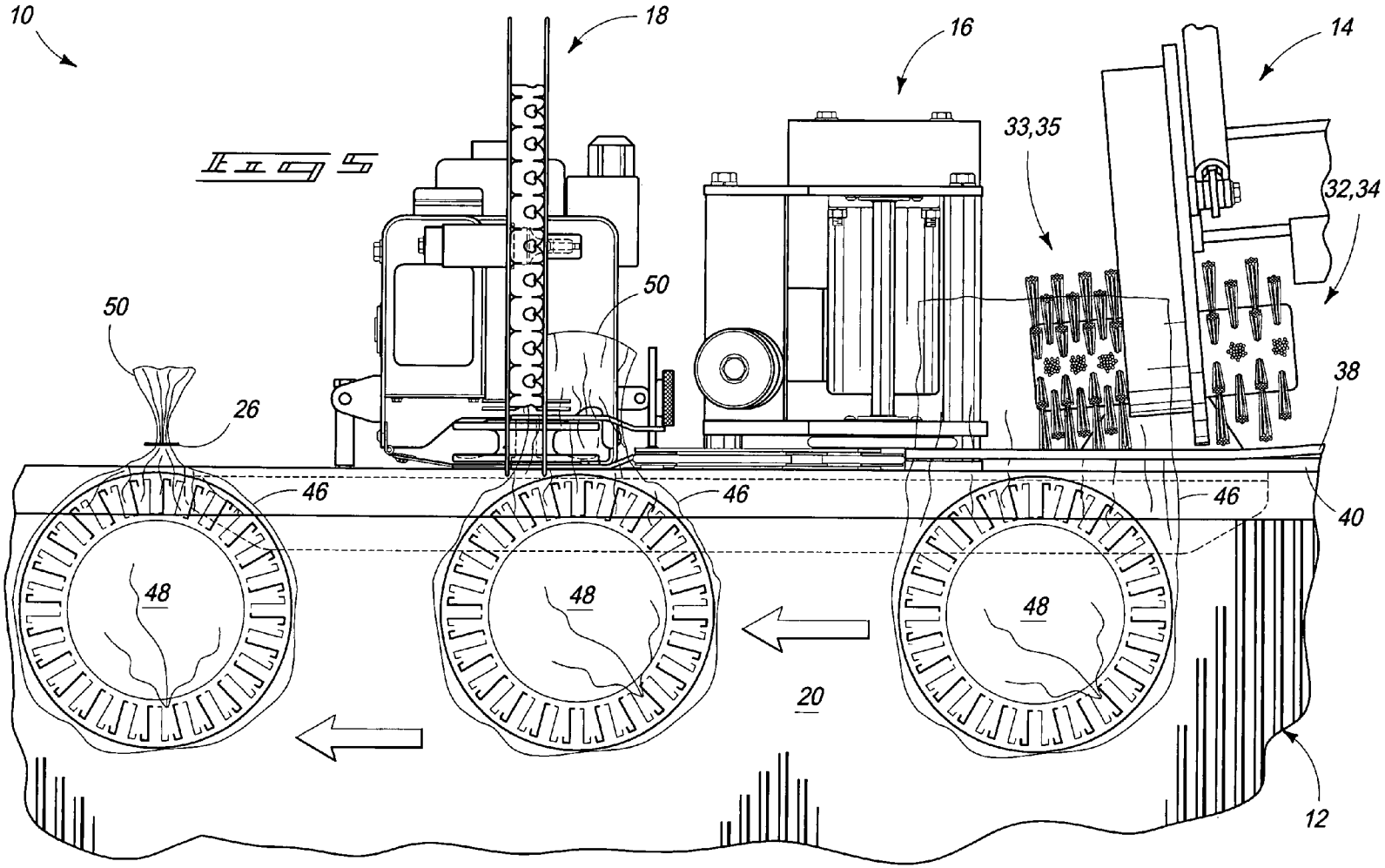
FIG. 5 is a plan view corresponding with the partial perspective view of FIG. 1 and illustrating a bag containing articles being progressively moved later in time than that depicted in FIG. 4 into a bag closing device of the bag fastening system.

In FIG. 5, plastic bag 46 and articles 48 are shown even further in time than depicted in FIG. 4 where bunched-up open neck portion 50 is delivered into bag closing device 18 where a clip 26 is then applied onto open neck portion 50. Bag closing device 18 further bunches up open neck portion 50 while applying clip 26 thereon. Additionally, a completely closed plastic bag 46 is also shown downstream and another bag is also shown upstream as it is being processed into bag accumulating device 16.

Figure 6:
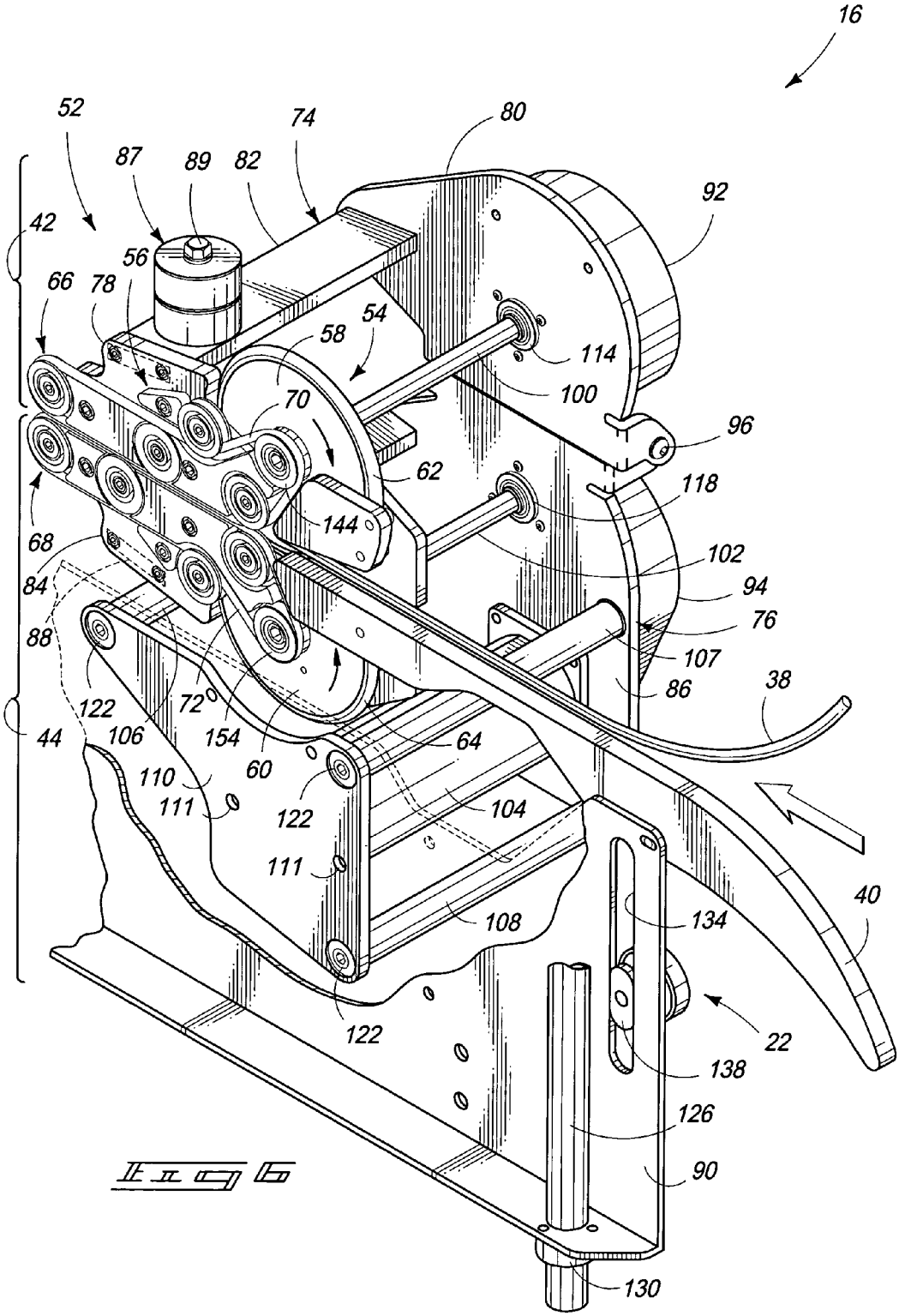
FIG. 6 is an enlarged partial perspective view of the bag accumulating device of FIGS. 1-5 and illustrating a more detailed construction of the bag accumulating device.

FIG. 6 illustrates bag accumulating device 16 in enlarged perspective view. Device 16 includes an upper drive assembly 42 that is pivotally supported atop a lower drive assembly 44 and is forced into engagement with lower drive assembly 44 by downward gravitational attraction of upper drive assembly 42. Alternatively, upper drive assembly 42 can be downwardly engaged with lower drive assembly 44 using a spring, or clamp assembly. Upper drive assembly 42 and lower drive assembly 44 cooperate to provide a bag accumulating mechanism 52 that receives a flattened and smoothed-over open neck portion of a plastic bag in order to bunch up the open neck portion and shorten the width of the open neck portion along a travel direction of the bag down a conveyor.

Bag accumulating mechanism 52 includes a wheel drive mechanism 54 and a track drive mechanism 56 that is provided downstream and immediately adjacent to the wheel drive mechanism 54. In operation, wheel drive mechanism 54 provides a first drive mechanism that moves an open neck portion of a bag at a first velocity, and track drive mechanism 56 provides a second drive mechanism that moves the open neck portion of a bag at a second, slower speed. By moving an open neck portion of a bag at a relatively high speed through wheel drive mechanism 54 and into a relatively slower moving track drive mechanism 56, the open neck portion of the bag is caused to bunch up, or accumulate, within track drive mechanism 56. Accordingly, the width of the open neck portion of a bag is narrowed as it is bunched together, which facilitates more efficient, quick, and accurate placement of clips onto bags when the bags are subsequently moved downstream into a bag closing device.

Wheel drive mechanism 54 includes a pair of co-acting drive wheels 58 and 60 that are positioned above and below a travel path 219 (see FIG. 8) for an open neck portion of a bag. Wheels 58 and 60 are driven in counter-rotation so as to advance an open neck portion of a plastic bag at a first speed into track drive mechanism 56. Each wheel 58 and 60 is integrally formed along with a drive wheel 144 and 154, respectively, from a single piece of machined aluminum alloy material. Wheels 58 and 60 are each mounted onto a first end of an idler shaft 100 and a drive shaft 102, respectively. Shafts 100 and 102 are driven in counter-rotation by gears 264 and 266 (see FIG. 15) provided beneath an idler gear cover 92 and a drive gear cover 94, respectively. An electric motor 104 is configured to drive the respective gears' so as to drive shafts 100 and 102 in counter-rotation. Further details of the gears are depicted with reference to FIGS. 12 and 15, below.

According to one construction, drive motor 104 comprises an alternating current (AC) variable speed gear motor. One suitable motor is sold by Brother Gearmotors of Bridgewater, N.J., and is a 1/50 horsepower variable speed gear motor having a 5:1 ratio, with a final output of 360 revolutions per minute (RPM).

As shown in FIG. 6, wheel 58 is integrally formed from a single piece of aluminum material along with a drive wheel 144 that is configured to drive a top track assembly 66 of track drive mechanism 56. Likewise, wheel 60 is integrally formed from a single piece of aluminum alloy material with a drive wheel 154 that drives a bottom track assembly 68 of track drive mechanism 56. Accordingly, wheels 58 and 144 share a common axis of rotation. Likewise, wheels 60 and 154 share a common axis of rotation. Hence, wheels 58, 144 and 60, 154 are driven in counter-rotation by shafts 100 and 102, respectively, at a desired operating speed (revolutions per minute) through controlled operation of motor 104 via a motor control system.

As a result of the differing diameters between wheels 58 and 144, as well as wheels 60 and 154, wheel drive mechanism 54 imparts a faster transfer speed to an open neck of a plastic bag that is delivered therebetween than does the track drive mechanism 56. The difference in such contact velocities causes bunching up of the open neck portion of a bag as the bag is delivered into track drive mechanism 56 from wheels 58 and 60, between top track assembly 66 and bottom track assembly 68. Accordingly, the open neck portion of the bag is bunched up and shortened (or accumulated) between assemblies 66 and 68.

Wheels 58 and 60 comprise cylindrical wheels, each having a radial outermost ring 62 and 64, respectively, formed of a frictionable elastic material that is configured to engage with the open neck portion of a bag. More particularly, the frictionable elastic material comprises a synthetic rubber material, such as an O-ring material. A circumferential groove is provided on the radial outermost edge of each wheel 58 and 60 having a semi-cylindrical cross-sectional configuration. Rings 62 and 64 each comprise an O-ring having a cylindrical cross-sectional configuration that stretches around wheels 58 and 60, respectively, for insertion into the semi-cylindrical groove provided on the radial outermost edge of each wheel. According to one construction, rings 62 and 64 are each made from an O-ring comprising ethylene propylene diene monomer (EPDM). Further details of such construction are illustrated below with reference to FIGS. 12-14 and 16-17.

Track assemblies 66 and 68 of track drive mechanism 56 each include a respective band 70 and 72 of frictionable elastic material, such as an O-ring of synthetic rubber material. Bands 70 and 72 are supported by track assemblies 66 and 68, respectively, to provide for a pair of co-acting and counter-rotating bands that are configured to be driven in counter-rotation. According to one construction, bands 70 and 72 are each made from an O-ring comprising Buna N or Nitrile, a copolymer of butadiene and acrylonitrile.

In operation, an open neck portion of a plastic bag is fed between the counter-rotating bands 70 and 72 to accumulate and foreshorten the open neck portion. The open neck portion of the bag is accumulated and foreshortened across the bag opening width because the wheel drive mechanism 54 operates at a higher velocity than the track drive mechanism 56. More particularly, bands 70 and 72 advance the open neck (or mouth) portion of the bag at a slower, second operating speed than the first operating speed of rings 62 and 64. During the accumulation process, the open neck portion of a bag extends between both wheels 58 and 60, as well as between bands 70 and 72.

As shown in FIG. 6, upper drive assembly 42 includes an upper frame 74. Upper frame 74 includes a pair of sidewalls 78 and 80 that are rigidly affixed together with a cross-member 82. Sidewalls 78 and 80 are rigidly affixed at opposite ends to cross-member 82 using pairs of recessed, threaded fasteners 164 and 165 (see FIG. 8). Similarly, lower drive assembly 44 includes a lower frame 76 formed from a pair of side walls 84, 86 and a cross-member 82 that rigidly secures together sidewalls 84 and 86. Upper frame 74 is pivotally affixed to lower frame 76 by way of a pair of hinges 96 and 98 (see FIG. 15). Wheels 58 and 60 and bands 70 and 72 are forced into engagement by gravitational attraction of top track assembly 66 downwardly toward bottom track assembly 68, about hinges 96 and 98. Optionally, top track assembly 66 can be driven into engagement with bottom track assembly 68 by way of a spring, elastic band, clip, or fastener.

In order to adjust the engagement force between wheels 58 and 60 and bands 70 and 72, one or more weights 87 can be mounted atop cross-member 82 by way of a fastener 89. For example, a threaded bolt can be passed through a complementary bore in a weight and engaged within a threaded bore in cross-member 82. Depending on the type of bag being accumulated, balance weights 87 may not be necessary, and can be removed. In other cases, it may be desirable to adjust the gravitational forces imparted to top track assembly 66 by changing the mass of corrector weights 87 by merely adding or removing weights, or changing the size of a specific weight (or weights) that is (are) mounted atop cross-member 82.

Bag accumulating device 16 is affixed onto the conveyor table by mounting bag accumulating device 16 rigidly onto a vertical mounting plate 90 that is provided on one side of the conveyor table. Mounting plate 90 is configured to be raised and lowered to position the bag arranging device 14 (not shown), bag accumulating device 16, and bag closing device 18 (not shown) at a desired elevation relative to a horizontal top surface of the conveyor table.

More particularly, mounting plate 90 has a vertical surface onto which a mounting plate 110 of bag accumulating device 16 is rigidly affixed with fasteners. Plate 90 includes a pair of bushings, such as bushing 130, that move up and down along respective rods, such as vertical rod 126 that is rigidly affixed in a stationary position to the conveyor table. Additionally, a slider plug 138 slides within a slot 134 of plate 90 to guide plate 90 for vertical positioning at desired locations. A kinematic linkage (not shown) is used to articulate plate 90 up and down to desired positions where plate 90 is positioned for operation at a desired elevation.

The pair of slider plugs, such as slider plug 138, are each rigidly affixed to a side edge of the conveyor table with a fastener in order to slide within a slot, such as slot 134, to further vertically guide plate 90 for vertical positioning at a desired elevation. Accordingly, table elevator mounting assembly 22 includes plate 90 which enables desired elevational positioning of bag accumulating device 16, as shown in FIG. 6. Further details of slider plugs 136 and 138 are shown with respect to FIG. 7 below.

Lower frame 76 also includes mounting plate 110 which is mounted rigidly in spaced-apart relation from sidewall 86 by way of a plurality of mounting plate spacers 106-108. Spacers 106-108 are rigidly affixed at either end by way of recessed, threaded fasteners 122 that affix plate 110 onto one end of spacers 106-108, and affix an opposite end of spacers 106-108 rigidly onto sidewall 86. Mounting plate 110 is then rigidly affixed via a pair of fasteners 262 (see FIGS. 12 and 14) onto a back face of vertical mounting plate 90 in order to support bag accumulating device 118 rigidly there against.

As shown in FIGS. 6 and 12-14, idler shaft 100 is supported at either end by bearing assemblies 114 and 116, whereas drive shaft 102 is supported for rotation at either end by bearing assemblies 116 and 118. Accordingly, a bag accumulating device 16 is provided between a first drive mechanism 54 and a second drive mechanism 56. The first drive mechanism 54 is configured to advance an open-mouth portion of a bag at a first speed. The second drive mechanism 56 is provided adjacent and downstream of the first drive mechanism. The second drive mechanism 56 is configured to advance the open-mouth portion of the bag at a second speed that is less than the first speed so as to accumulate and foreshorten (or bunch) the open-mouth portion of the bag. Accordingly, second drive mechanism 56 cooperates with first drive mechanism 54 to gather together (at least in part) the open neck portion of a bag.

FIG. 7 illustrates the orientation of bag accumulating device 16 on table elevator mounting assembly 22. Other devices on the bag fastening system have been omitted in this drawing in order to focus on the mounting features of bag accumulating device 16.

As shown in FIG. 7, a pair of corrector weights 87 are removably fastened onto upper frame 74 to adjust the gravitational force with which wheel 58 engages wheel 60, as well as band 70 engages band 72. Weights 87 can be removed, or additional weights can be added in order to adjust the contact force and friction generated between wheels 58 and 60 and bands 70 and 72 against a bag that is conveyed therebetween. By pivotally mounting upper frame 74 onto lower frame 76, the gravitational pull acting on upper frame 74 and weights 87 imparts a desired contact friction between wheels 58 and 60 and bands 70 and 72. By adjusting such contact friction, the effectiveness of device 16 at drawing and accumulating a bag between bands 70 and 72 can be adjusted to best accommodate the thickness, material and stiffness properties of a particular bag that is being bunched up between bands 70 and 72.

As shown in FIG. 7, an entrance nip is provided between guide bars 38 and 40. Guide bars 38 and 40 facilitate the guiding of an open neck portion of a plastic bag between guide bars 38 and 40 for delivery into an entrance nip between wheels 58 and 60 for accumulation and bunching up of the Open neck portion of a bag between bands 70 and 72.

FIG. 7 further illustrates the arrangement of stationary guide rods 124 and 126 which are securely mounted to a side of a conveyor table. Additionally, Bronze bushings 128, 130 slide up and down guide rods 124 and 126, respectively. Additionally, slider plugs 136 and 138 are configured to cooperate with slots 132 and 134, respectively, to further facilitate vertical movement of plate 90 up and down to desired locations. Accordingly, devices on plate 90 are elevationally positioned at desired elevational levels relative to a horizontal position of a conveyor belt on a conveyor table. It is understood that slider plugs 136 and 138 are rigidly secured with fasteners to a side of a conveyor table, and slider plugs 136 and 138 function to secure plate 90 for vertical movement along slots 132 and 134, respectively, while preventing any lateral motion therebetween. Hence, plate 90 is restrained to move up and down by way of such components to enable setting a desired operating height for the accompanying devices.

According to one construction, the bag fastening system, including bag accumulating device 16, and the table elevator mounting assembly 22 of the conveyor table are constructed to scale as shown in FIGS. 1-19, so as to have a centerline distance of 24¼ inches between guide rods 124 and 126. It is understood that other dimensions and scales can also be utilized in modifications of these embodiments.

FIG. 8 illustrates in enlarged partial breakaway view components of bag accumulating device 16 that provide wheel drive mechanism 50 and track drive mechanism 56. Lower portions of lower drive assembly 44 have been omitted from this view in order to facilitate enlarged viewing of components that form wheel drive mechanism 54 and track drive mechanism 56.

Wheel drive mechanism 54 provides counter-rotating interaction between drive wheels 58 and 60. Drive wheels 58 and 60 each include a grip ring 62 and 64, respectively, which engage on opposite sides of an open neck portion of a plastic bag as the bag is received between wheels 58 and 60. According to one construction, wheels 58 and 60 are identical in diameter and are driven at the same speed, but in opposite directions, in order to achieve the same speed along the outer surfaces of rings 62 and 64.

Track drive wheel mechanism 56 includes top track assembly 66 and bottom track assembly 68. Tracks 66 and 68 each include a band 70 and 72, respectively, of frictionable elastic material that is configured to engage with opposite sides of an open neck portion (or mouth) of a plastic bag. Bands 70 and 72 co-act on opposite sides along an open neck portion of a plastic bag to accumulate and bunch up the bag therebetween. Bands 70 and 72 engage along an elongated contact section 221 where a travel speed of each band is provided which is less than the travel or contact speed between wheels 58 and 60. Accordingly, wheels 58 and 60 drive an open neck portion of a bag at a relatively high speed into and between bands 70 and 72, wherein bands 70 and 72 travel at a relatively lower speed. Accordingly, the open neck portion of the plastic bag is bunched up between bands 70 and 72, along elongated contact section 221. The resulting bunched-up open neck portion of a plastic bag is then carried or delivered between bands 70 and 72 to a downstream end of contact section 221 where it exits between wheels 150 and 160 for delivery to a bag closing device (not shown). By bunching up the open neck portion of a plastic bag within machine 16, a bag closing machine can more accurately, effectively, and quickly apply a clip onto the bunched-up open neck portion of a plastic bag.

Top track assembly 66 and bottom track assembly 68 provide a pair of co-acting band track assemblies that present band 70 and 72, respectively, to be driven in counter-rotation so as to engage along contact section 221. An open neck portion of a plastic bag is accumulated along such section 221 where it is foreshortened due to the higher delivery speed provided by wheel drive mechanism 54 relative to track drive mechanism 56. Bands 70 and 72 each comprise a flexible band that is driven for rotation in a circuit and is formed from frictionable material that grips an advancing open neck portion of a plastic bag. Bands 70 and 72 are provided about a respective closed-loop track, and a plurality of wheels support bands 70 and 72 for travel about the respective tracks or circuits.

More particularly, top track assembly 66 guides band 70 around a circuit by way of a drive wheel 144 that is integrally formed from wheel 58, and a plurality of bogie wheels 146, 148, 150 and 152. Drive wheel 144 and bogie wheels 146, 148, 150 and 152 are positioned about a perimeter of band 70, both along an inside perimeter and an outside perimeter, in order to keep band 70 aligned along a circuitous path. Accordingly, drive wheel 144 also provides a bogie wheel. Wheels 144, 146, 148, and 150 are provided along an inside perimeter of band 70, whereas wheel 152 is provided along an outside perimeter of band 70 to further direct band 70 along a desired circuitous path.

Similarly, bottom track assembly 68 comprises band 72 which is driven around a similar circuitous path, in counter-rotation relative to band 70. A drive wheel 154 is formed integrally from wheel 60, and a plurality of bogie wheels 156, 158, 160 and 162 are provided about band 72 to support band 72 for motion about a circuitous path, in a manner similar to band 70.

In order to guide band 70 around a circuitous path, wheels 146, 148, 150 and 152 are supported for rotation by a track member 140. Track member 140 also provides grooves 168 and 170 which further guide and support band 70 for movement along a desired circuitous, rotational path. Track member 140 is rigidly affixed onto sidewall 78 in threaded bores (not shown) via a pair of recessed, threaded fasteners 164 and 166.

Similarly, track member 142 supports bogie wheels 156, 158, 160 and 162 for rotation thereon. Track member 144 also includes a similar set of grooves 172 and 174 configured to guide and support band 72 along a circuitous path. A pair of recessed, threaded fasteners 166 and 167 is configured to mount track member 144 onto respective sidewall 84 via respective threaded bores (not shown) in sidewall 84.

In order to ensure that elongated contact section 221 grips and holds a bunched-up open neck portion of a plastic bag, bogie wheels 148 and 154 are laterally disposed relative to a straight line through adjacent bogie wheels 146, 150 and 156, 160, respectively. More particularly, bogie wheel 144 is displaced downwardly of adjacent bogie wheels 150 and 146 by a displacement distance 188 that forms a linear bias, as bogie wheel 144 has the same diameter as bogie wheels 146 and 150. Such displacement 188 of bogie wheel 148 imparts a zigzag to contact section 221.

Likewise, bogie wheel 158 is displaced upwardly a displacement distance 190 relative to bogie wheels 156 and 160. Bogie wheels 156, 158 and 160 are each the same diameter. Accordingly, a displacement distance 190 upwardly biases bogie wheel 158 so as to laterally bias contact section 221 further, which imparts an additional zigzag to contact section 221. The downward bias of band 70 due to bogie wheel 148 imparts an interference contact between bands 70 and 72 there adjacent. Likewise, the upward bias due to bogie wheel 158 by displacement distance 190 imparts an additional interference between bands 72 and 70 by upwardly biasing band 72 into forcible engagement with band 70.

Accordingly, it has been found that the bias distance 180 of bogie wheel 148 and the bias distance 190 of bogie wheel 158 impart improved and more sufficient engagement between bands 70 and 72. This improved engagement further encourages bunching up of an open neck portion of a plastic bag therebetween, as well as delivery of such bunched-up bag downstream via band 70 and 72 to an exit nip between bogie wheels 150 and 160. By improving the ability to bunch up an open neck portion of a bag and retain the bunched-up bag in such a configuration, the bunched-up open neck portion of a plastic bag can be more effectively delivered to a bag closing machine for application of a clip there about. As a result, clips can be applied at a greater operating speed, and such clips can be provided more accurately and more effectively, while reducing the likelihood that a clip will be misapplied onto the bunched-up open neck portion of a plastic bag.

Optionally, bogie wheels 148 and 158 can be eliminated to provide a linear contact section 221 between bands 70 and 72. Further optionally, second drive mechanism 56 can be formed by one or more wheels, tracks, shuttling devices, or other mechanisms capable of moving an open neck portion of a plastic bag. Similarly, first drive mechanism 54 can be formed by any mechanism capable of moving an open neck portion of a plastic bag.

Based on experimental tests, one desirable operating speed imparts a rotational velocity to drive wheels 58 and 60 sufficient to drive an outermost surface of rings 62 and 64 at a tangential velocity of 250 feet per minute. A corresponding desirable speed for bands 70 and 72, along contact section 221, delivers a tangential speed of 75 feet per minute. Although it is understood that such velocities impart a desirable bunching up of an open neck portion of a bag, it is understood that other speeds and ratios of relative speeds are possible in order to encourage bunching up of an open neck portion of a bag between bands 70 and 72. Effective bunching will occur as long as wheel drive mechanism 54 imparts a higher tangential velocity than does track drive mechanism 56. According to one implementation, a desirable operating speed for a conveyor belt can fall anywhere within the range of 40-70 feet per minute. However, it is understood that any other operating speed for a conveyor belt would also work with the above-described operating speeds for wheel drive mechanism 54 and track drive mechanism 56.

As shown in FIG. 8, sidewall 78 is rigidly affixed to cross-member 82 using a pair of recessed, threaded fasteners 176 and 177. Likewise, sidewall 84 is rigidly affixed onto cross-member 88 using a similar set of recessed, threaded fasteners 178 and 179.

Figure 19:
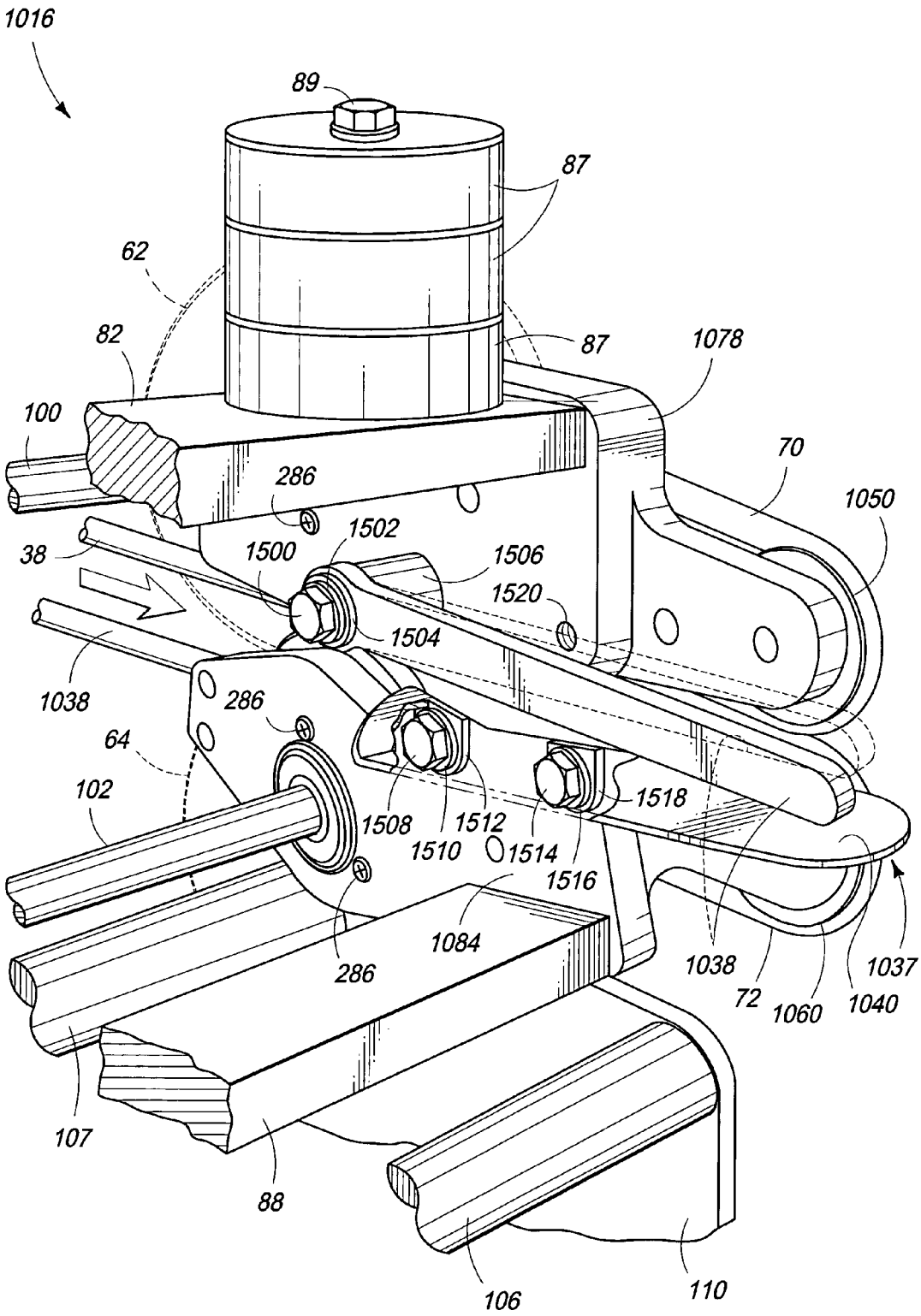
FIG. 19 is an enlarged partial perspective view illustrating guide features for the alternatively constructed drive mechanism of FIG. 18.

As shown in FIG. 8, only a pair of weights 87 are depicted in partial sectional view to'reduce height of the drawing. Fastener 89 affixes weights 87 onto cross-member 82. An optional weight configuration is depicted in FIGS. 18 and 19. It is understood that any number of weights 87 can be used (as well as any combination, including removal of the weights).

A safety guide 180 is also affixed onto sidewall 78 using a recessed, threaded fastener 184. Likewise, another safety guide 182 is affixed onto sidewall 84 via another recessed, threaded fastener 186. Safety guides 180 and 182 are mounted in an entrance nip between bogie wheel 152 and band 70, as well as bogie wheel 162 and track 72, respectively, in order to prevent an operator from inadvertently snagging an article therein. For example, a finger or a piece of material can otherwise be caught in the respective entrance nip. Accordingly, safety guides 180 and 182 provide a safety feature that reduces or eliminates injury or jamming of the respective track assembly 66 and 68 from foreign articles.

As shown in FIG. 8, upper guide bar 38 is welded at a proximal end onto a guide bracket 196. Guide bracket 196 includes a pair of threaded, through-bores 198 and 199, and threaded fasteners 192 and 193 pass through clearance holes in bushings 216 and 218, respectively, for threading into threaded bores 198 and 199. Accordingly, guide bar 38 and accompanying guide bracket 196 are rigidly affixed onto sidewall 78 in spaced-apart relation via bushings 216 and 217.

Similarly, lower guide bar 40 is rigidly affixed onto sidewall 84 by providing a threaded through-bore 200 in guide bar 40. A threaded fastener 194 is received through a bore in sidewall 84, through a bushing 218, and into threaded bore 200 for securing guide bar 40 rigidly onto sidewall 84.

Bushings 216, 217 and 218 serve to rigidly affix guide bracket 196 and guide bar 40, respectively, in rigid, spaced-apart relation with respective sidewalls 78 and 84. As shown in FIG. 8, elongated contact section 221 forms a zigzag pattern relative to a horizontal track plane 219. Track plane 219 defines an idealized plane, or track, upon which an open neck portion of a plastic bag is delivered by a conveyor belt.

Figure 9:
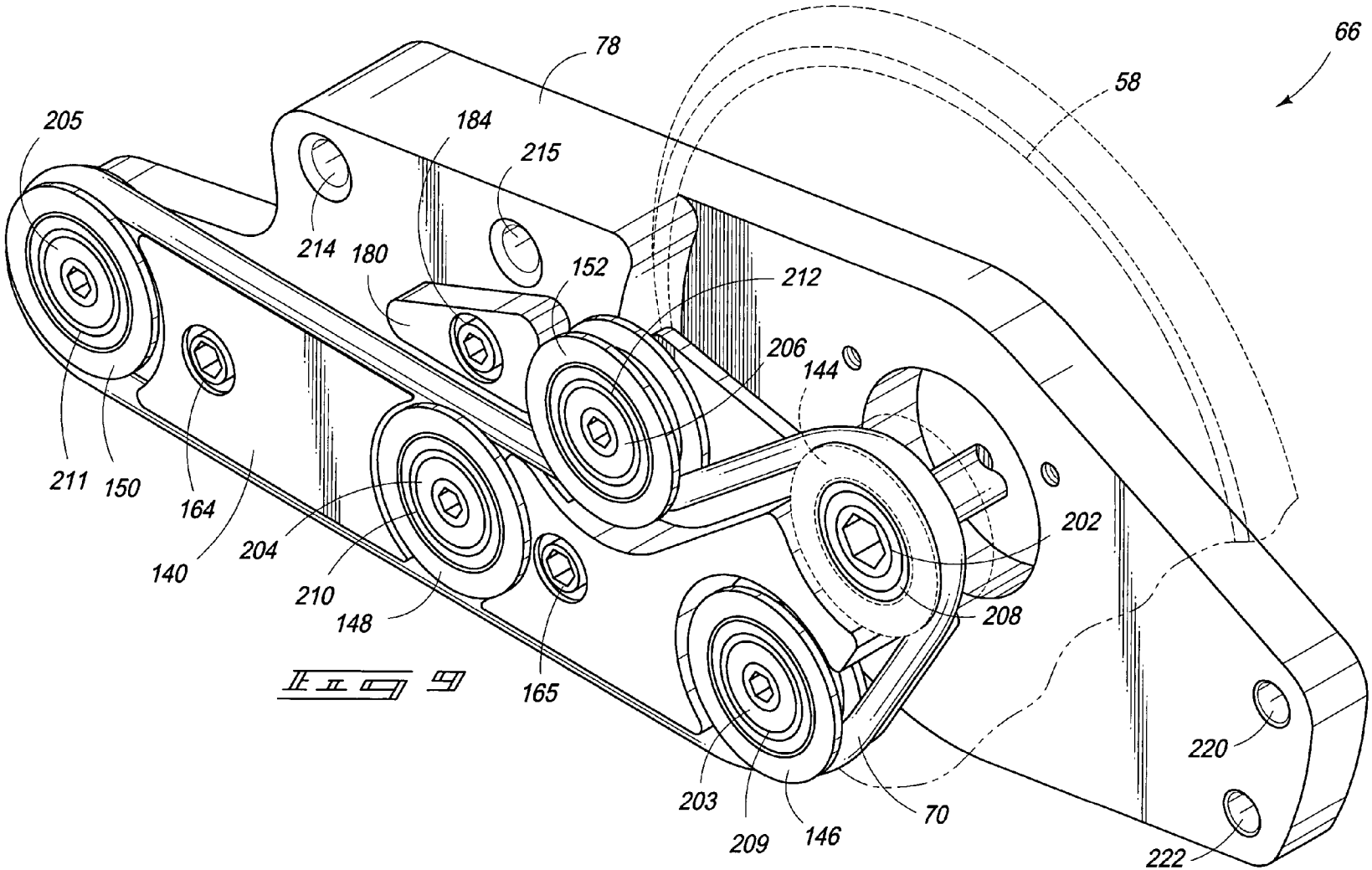
FIG. 9 is an enlarged perspective view illustrating a top track and sidewall assembly for the bag accumulating device of FIGS. 1-8.
Figure 11:
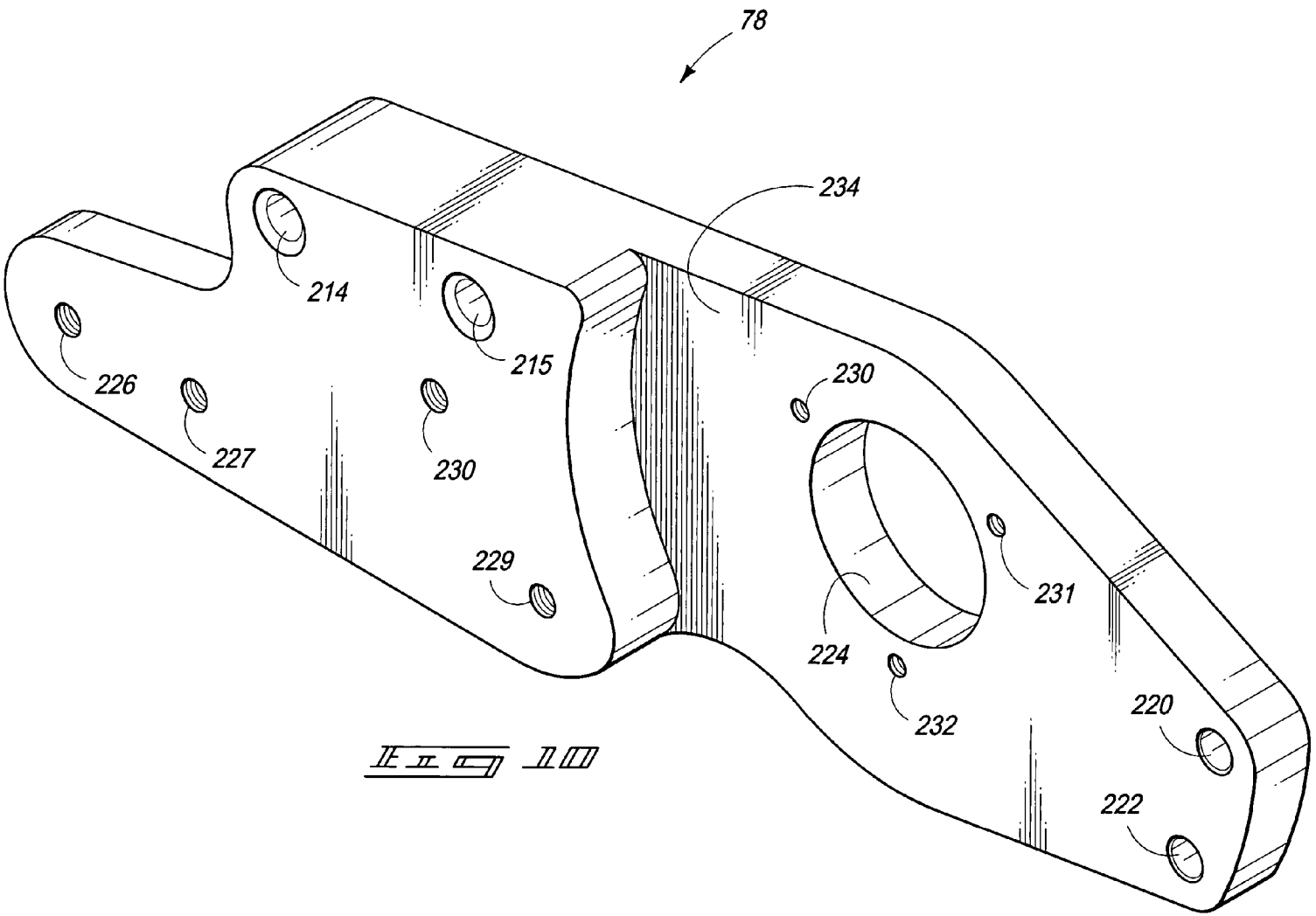
Figure 11:
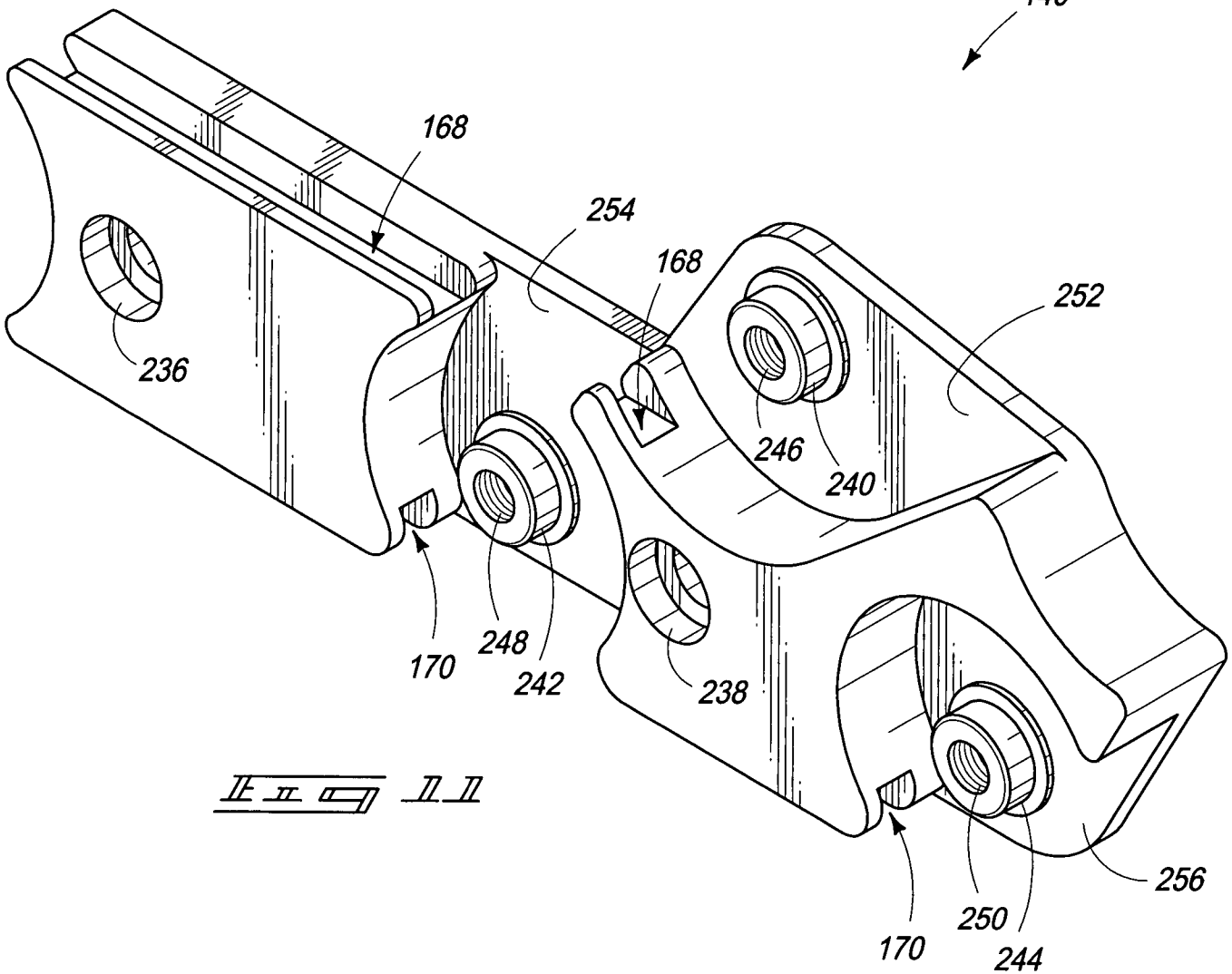

FIG. 9 illustrates a partial perspective view depicting sub-assembly construction of top track assembly 66. It is understood that bottom track assembly 68 is similarly constructed. More particularly, track 140 is shown securely fastened onto sidewall 78 via a pair of threaded fasteners 164 and 165, with wheel 58 shown in phantom view. However, side plate 78 is not assembled onto a respective cross-member in this view. Accordingly, a pair of through-bores 214 and 215 are shown configured to receive threaded fasteners for mounting sidewall 78 onto such cross-member. Wheels 58 and 144, which are integrally formed from a single piece of aluminum alloy material, are shown in phantom view to facilitate viewing of respective portions of sidewall 78 in assembly. Furthermore, a bearing assembly on which wheels 158 and 144 are rotatably mounted is omitted from such view.

Wheels 58 and 144 are rigidly mounted onto an idler shaft 100 (see FIG. 12) via a recessed, threaded fastener 202 and a drive wheel retainer 208 into which the fastener 202 is received. Similar recessed, threaded fasteners 203-206 cooperate with bearing retainers 209-212 to secure bogie wheels 146, 148, 150 and 152 in rotating relation on track member 140. Accordingly, frictionable and resilient band 70 is carried about a circuitous path via track member 140 where band 70 is driven in rotation in a single direction by drive wheel 144. Wheels 146, 148, 150 and 152 act as idler wheels to guide band 70 about the circuitous path.

As shown in FIGS. 9 and 10, a pair of through-bores 220 and 222 are configured to receive fasteners 192 and 193 that mount guide bracket 196 and guide bar 38 onto sidewall 78 (see FIG. 8).

Additionally, safety guide 180 is shown mounted onto sidewall 78 via threaded fastener 184. A recessed through-bore is provided in safety guide 180 through which fastener 184 passes for threaded engagement within a threaded bore 230 of sidewall 78 (see FIG. 10). Accordingly, a single fastener securely engages safety guide 180 against sidewall 78 to prevent loose items or fingers from being caught within an entrance nip between wheel 152 and band 70.

FIG. 10 illustrates sidewall 78 in an unassembled state. More particularly, bores 214 and 215 are shown for receiving a fastener when mounting sidewall 78 onto cross-member 82 (see FIG. 6). Threaded bore 226 is configured to receive fastener 205 and to mount wheel 150 for rotation thereabout (see FIG. 9). Threaded bores 227 and 229 are provided in spaced-apart relation for receiving fasteners 164 and 165, respectively, to rigidly mount track member 140 onto sidewall 78 (see FIG. 9).

Figure 12:
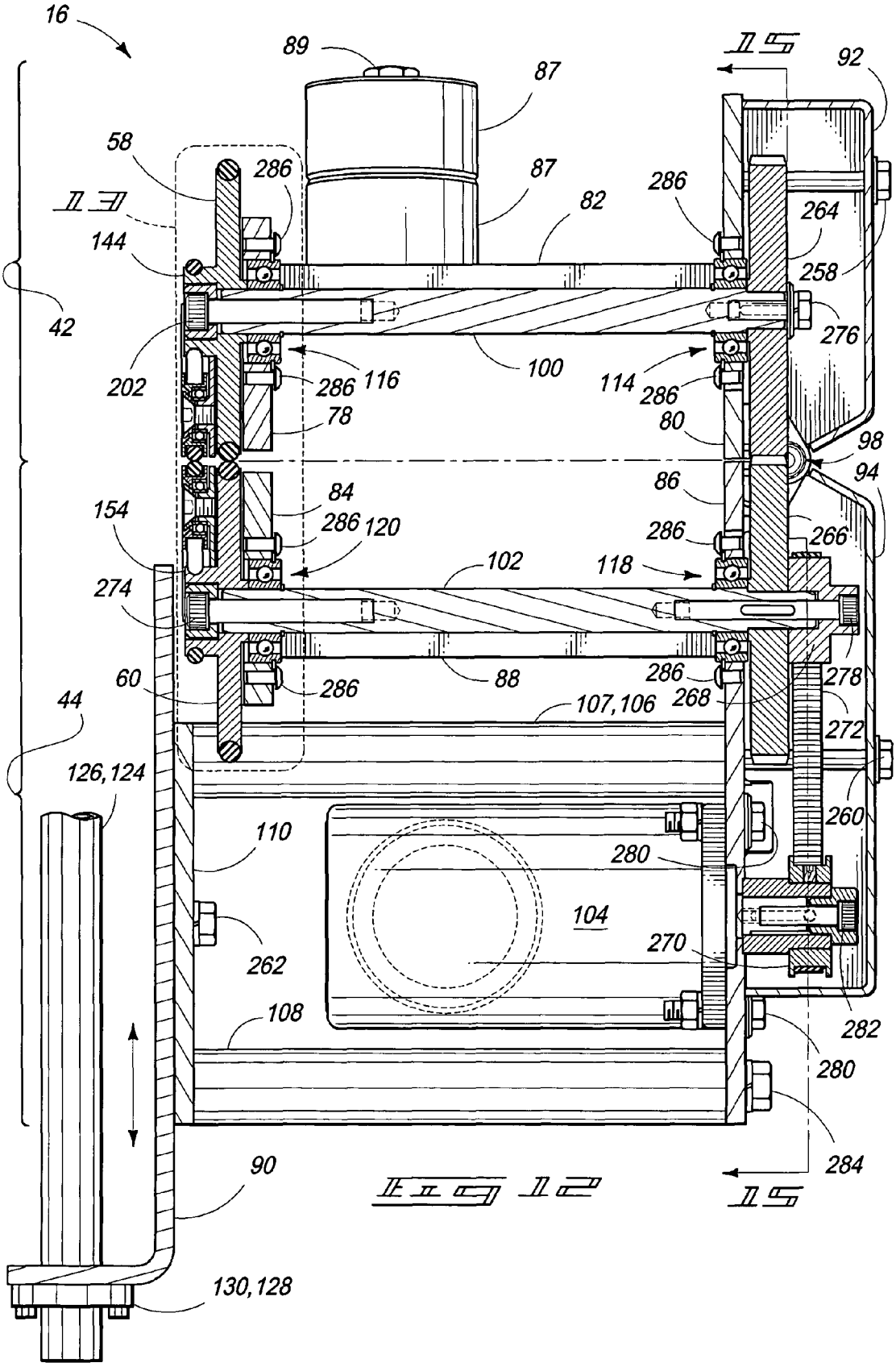
FIG. 12 is a cross-sectional view taken along line 12-12 of FIG. 7 and illustrating construction of the bag accumulating device.

In order to provide clearance for drive wheel 58 (see. FIG. 9), sidewall 78 includes a recessed surface 234. Recessed surface 234 includes a through-bore 224 configured to form a seat for mounting a cylindrical bearing 116 (see FIGS. 12 and 13). A plurality of threaded fasteners 286 (see. FIG. 12) are received into respective threaded bores 230-232 to retain a bearing within seat 224. Through bores 220-221, as previously discussed, are provided for mounting an upper guide bar onto sidewall 78.

Figure 11:
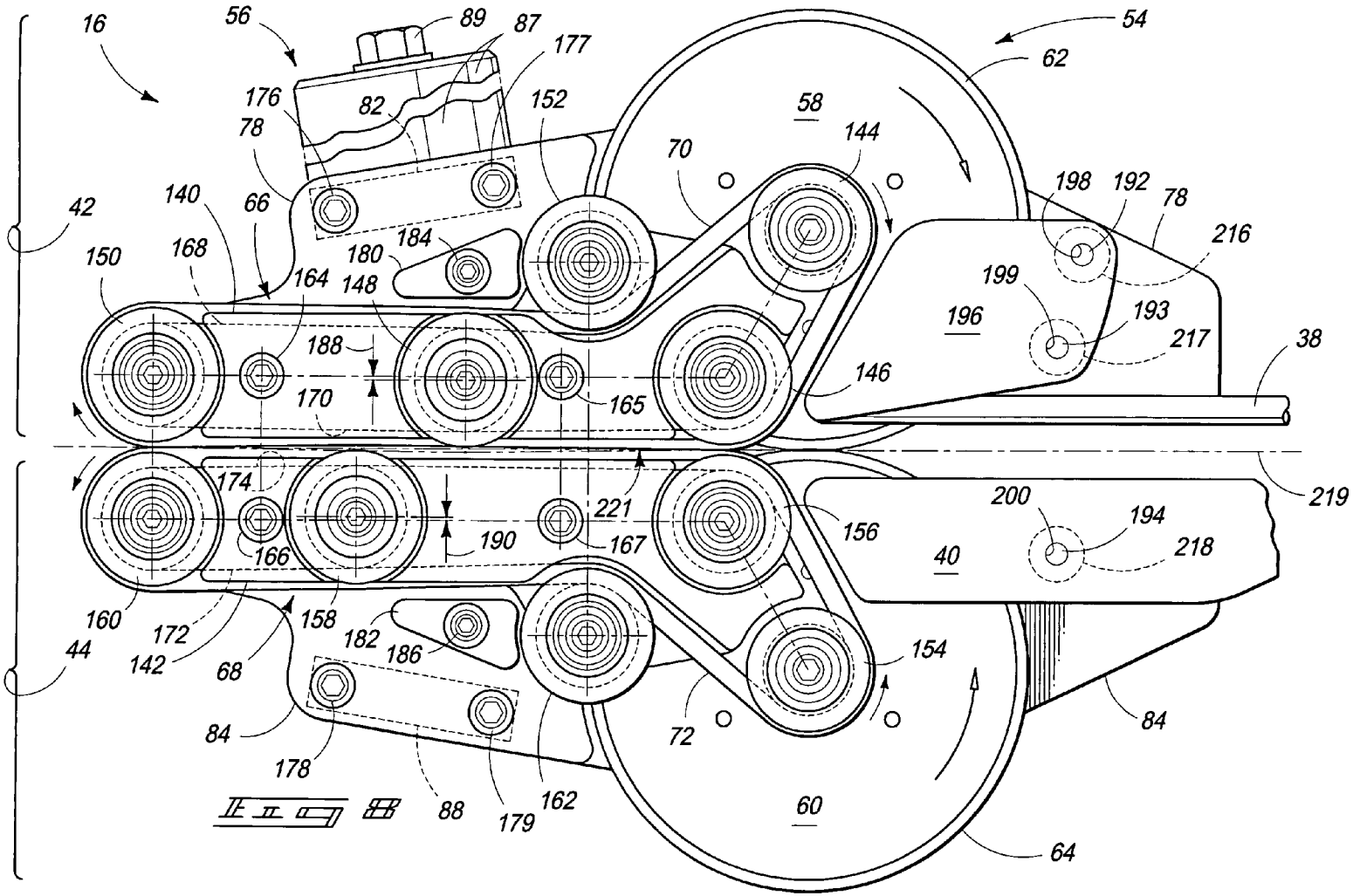
FIG. 11 is an enlarged perspective view of a track member for the top track assembly of FIG. 9.

FIG. 11 illustrates an unassembled view of track member 140. Track member 140 includes a segmented upper groove 168 and a segmented lower groove 170 which assist in guiding and supporting a band of O-ring material; namely, band 70 (see FIG. 9). A pair of recessed-head through-bores 236 and 238 extend completely through track member 140 for receiving fasteners 164 and 165 (see FIG. 9) to mount track member 140 onto sidewall 78. As shown, bores 236 and 238 have an enlarged portion for receiving the head of such a fastener and a reduced-diameter portion that extends completely through track member 140 to capture the head of the fastener, but still allow the shaft of the fastener to pass therethrough.

Track member 140 also includes recessed surfaces 252, 254 and 256. Surface 252 supports an integrally formed stud 240 having a centered, threaded bore 246. Stud 240 forms a circumferential seat onto which a cylindrical bearing (similar to bearing 212 in FIG. 13) is received. Bogie wheel 152 is then secured via fastener 206 and bearing retainer 212 by receiving such fastener 206 into threaded bore 246. Similarly, surface 254 provides an integral stud 242 having a threaded bore 248. A similar cylindrical bearing is received about stud 242 about which bogie wheel 148 is mounted for rotation via fastener 204 and bearing retainer 210. Fastener 204 is received in threaded engagement within threaded bore 248 in assembly. Even furthermore, surface 256 supports integrally formed stud 244 in which a threaded bore 250 is provided. A similar cylindrical bearing (not shown) is provided about stud 244. Threaded fastener 203 and bearing retainer 209 are used to affix bogie wheel 146 for rotation about such bearing and stud 244 by threading fastener 203 into threaded bore 250.

FIG. 12 illustrates the construction of bag accumulating device 16 taken along line 12-12 of FIG. 7. Upper drive assembly 42 is shown engaged with lower drive assembly 44 as a result of gravitational attraction acting on upper drive assembly 42. Additionally, weights 87 are secured onto cross-member 82 via fastener 89 to enhance the gravitational forces with which upper drive assembly 42 is engaged against lower drive assembly 44. In the event that an undesirable object is inadvertently fed between upper drive assembly 42 and lower drive assembly 44, upper drive assembly 42 merely hinges or tilts up as depicted in FIG. 14 (but to a lesser degree), providing clearance for the undesirable object To a much lesser extent, the same lifting action is imparted to assembly 42 when a bag bunches up between the bands 70 and 72 (see FIG. 13) during accumulation of an open neck portion of a plastic bag therebetween. Hence, assemblies 42 and 44 accommodate the increased thickness of the bunched-up open neck portion of a bag. Since gravitational forces are used to engage together assemblies 42 and 44, materials and objects of varying thickness can be disposed and passed therebetween during delivery. Hence, upper drive assembly 42 is pivotally supported by hinges (such as hinge 98) relative to lower drive assembly 44.

As further shown in FIG. 12, vertical mounting plate 90 can be vertically adjusted in elevation as bushings 128 and 130 slide up and down stationary guide rods 124 and 126 of a conveyor table (not shown).

Also in FIG. 12, upper drive assembly 42 and lower drive assembly 44 are engaged for counter-rotation by way of a pair of intermeshing gears 264 and 266. More particularly, gear 264 comprises an idler gear that is rigidly affixed onto idler shaft 100 by trapping gear 264 between the reduced-diameter portion on shaft 100 and a threaded fastener 276. Another threaded fastener 202 rigidly secures a unitary component comprising wheel 58 and wheel 144 onto an opposite end of idler shaft 100. Idler shaft 100 is supported at one end via bearing 116 and at another end via bearing 114 for rotation there along.

Gear 266 intermeshes with gear 264 to drive gear 264 in counter-rotation relative to gear 266. Gear 266 is rigidly affixed onto one end of drive shaft 102 on a reduced-diameter portion via a threaded fastener 278 and a grooved pulley (or timing belt pulley) 268. Fastener 278 rigidly affixes together pulley 268, gear, 266, and shaft 102. At an opposite end, shaft 102 is rigidly affixed to the integrally formed gears 60 and 154 via a threaded fastener 274. Shaft 102 is supported for rotation at a first end via cylindrical bearing 120 and at a second end via cylindrical bearing 118. In assembly, bearings 114, 116, 118 and 120 are held within respective bores of the sidewalls in device 16 using three threaded fasteners 286 that are circumferentially spaced apart about each of the bearings.

In order to drive gears 264 and 266 in counter-rotation, a drive belt 272 engages with grooved pulley 268 and grooved pulley 270. Grooved pulley 270 is rigidly affixed onto a drive end of motor 104 using a threaded fastener 282. Accordingly, motor 104 drives pulley 268 via belt 272 and pulley 270 in order to counter-rotate gears 264 and 266. According to one construction, pulley 268 has 30 grooves (or teeth) and pulley 270 has 24 grooves (or teeth).

Bag accumulating device 16 is mounted onto vertical mounting plate 90 using a pair of side-by-side threaded fasteners 262 which are received into threaded bores (not shown) provided within plate 90. Alternatively, plate 90 has a pair of through-bores, and a nut is used to secure each fastener (bolt) 262. Fasteners 262 pass through corresponding clearance bores 111 (see FIG. 6) provided in mounting plate 110 of lower drive assembly 44. Mounting plate 110 is spaced apart from sidewall 86 via mounting plate spacers 106-108. Sidewall 84 is supported by a cross-member 88 from sidewall 86. Likewise, sidewall 78 is supported by cross-member 82 from sidewall 80. Threaded fasteners, such as fastener 284, are used to secure mounting plate spacers 106-108 onto sidewall 86. Likewise, recessed threaded fasteners (not shown) mount opposite ends of mounting plate spacers 106-108 securely onto mounting plate 110 at an opposite end. Motor 104 is mounted onto sidewall 86 by way of a plurality of threaded fasteners 280.

Also shown in FIG. 12, an idler gear cover 92 is fastened onto sidewall 80 via a pair of threaded fasteners 258 to shield and encase idler gear 264 therein. Similarly, a drive gear cover 94 is secured onto sidewall 86 with a pair of fasteners 260 to encase gear 266, pulley 272, and pulleys 268, 270 therebetween.

Figure 13:
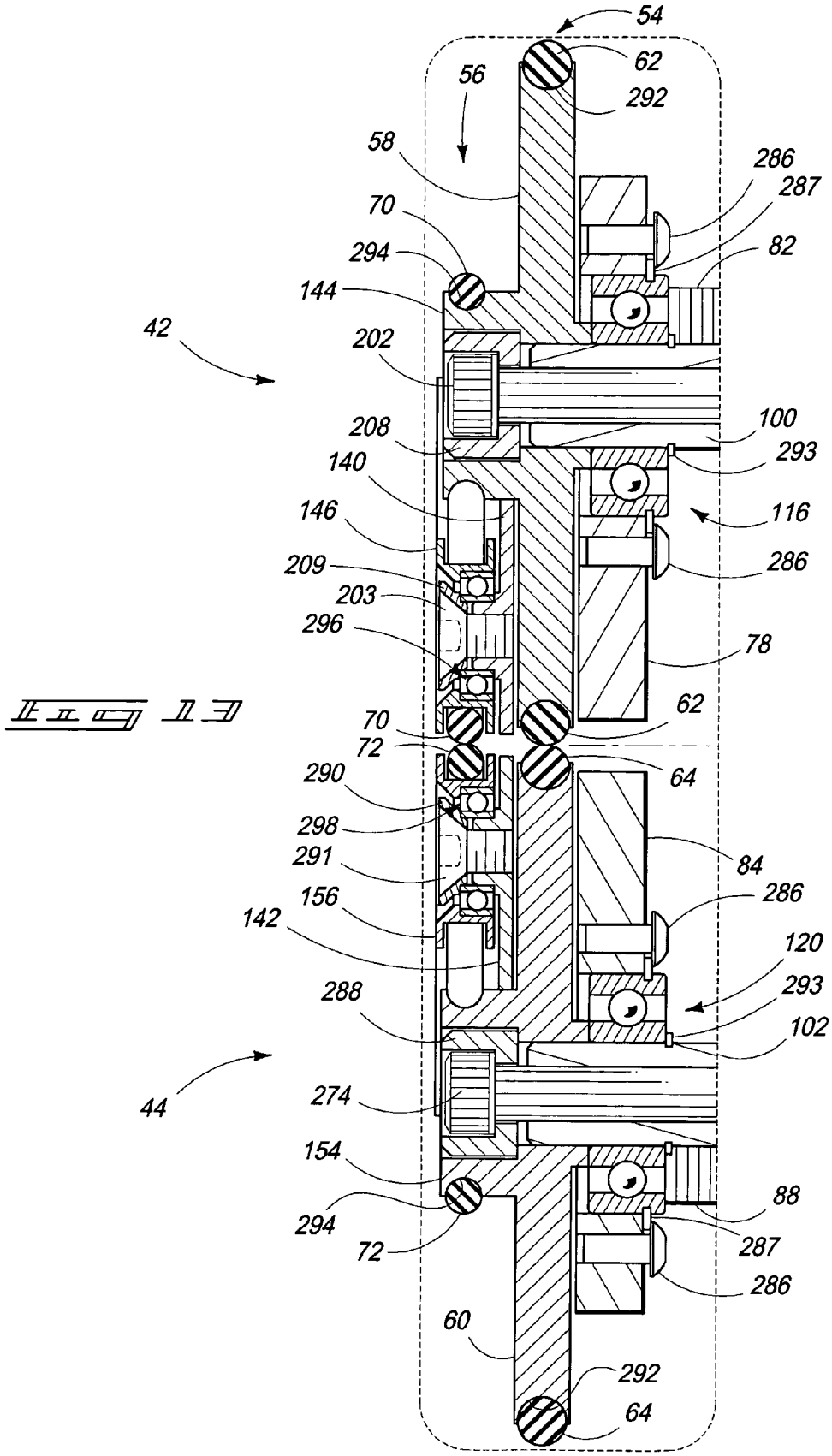
FIG. 13 is an enlarged sectional view of the encircled region 13 of FIG. 12 illustrating in greater detail the construction of drive mechanisms for the bag accumulating device of FIGS. 1-7.
Figure 14:
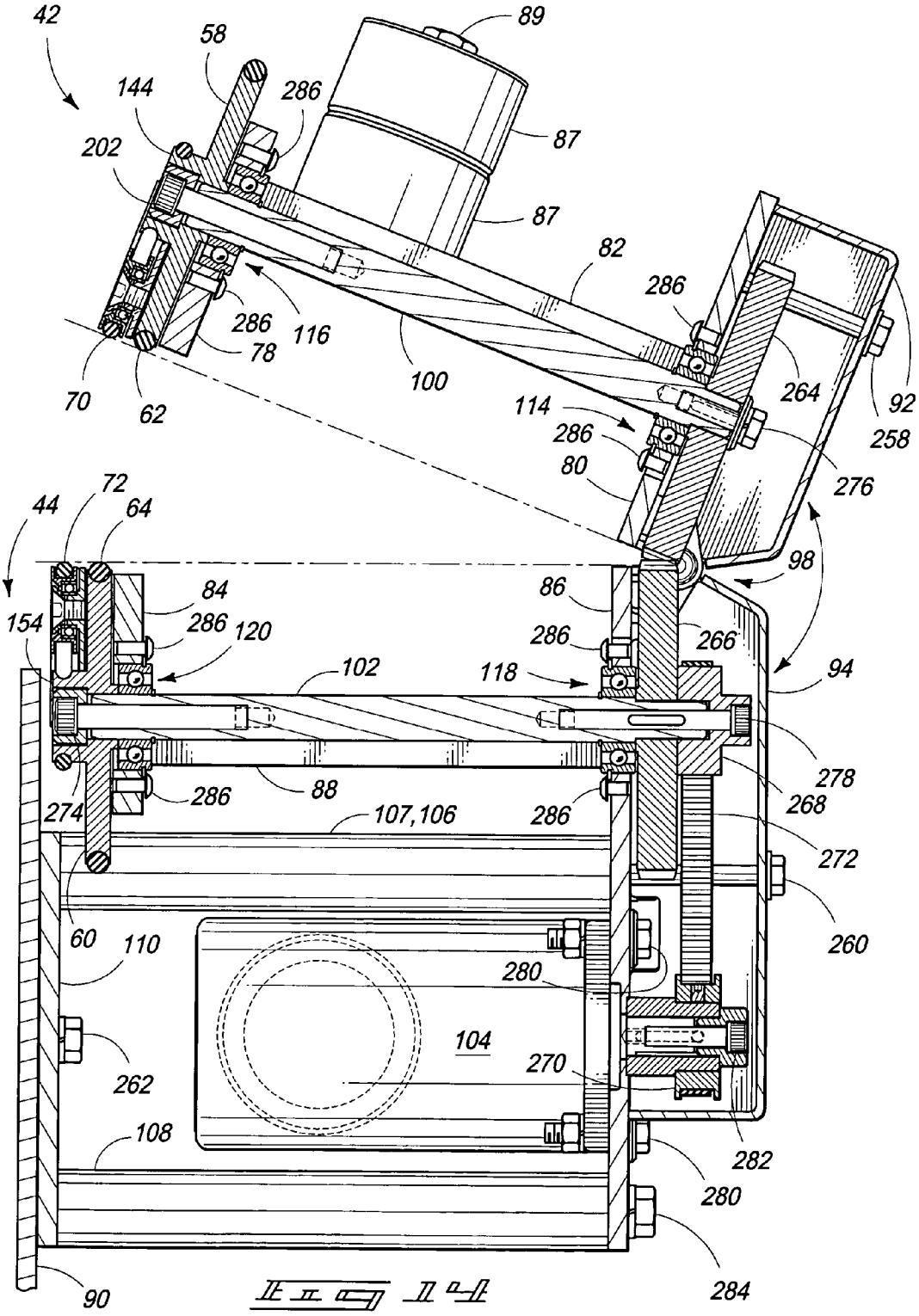
FIG. 14 is a sectional view corresponding with the view depicted in FIG. 11 for the bag accumulating device and illustrating articulation of an upper drive assembly pivotally away from a lower drive assembly.

FIG. 13 illustrates in greater detail an enlarged partial sectional view of the wheel drive mechanism 54 and the track drive mechanism 56 as shown in FIG. 12. More particularly, wheel drive mechanism 54 comprises drive wheels 58 and 60. Wheels 58 and 60 each have a semicircular groove 292 provided along a radial outermost edge of the respective wheels 58 and 60. Grip rings 62 and 64 are provided in groove 292 of each wheel 58 and 60, respectively. Rings 62 and 64, each formed from a rubber O-ring, have a cylindrical cross-sectional configuration, according to one construction.

Track drive mechanism 56 is also shown in FIG. 13. More particularly, band 70 is shown in cross-sections seated within a groove 294 of drive wheel 144 and within a groove of bogie wheel 146. Bogie wheel 146 has a groove comprising a substantially rectangular cross-sectional configuration into which band 70 is received. Preferably, the groove in each of the bogie wheels, such as bogie wheel 146, is slightly larger than the width of band 70 which serves to prevent band 70 from jumping out of the groove when in operation. Similarly, band 72 is shown seated within groove 294 of drive wheel 154, as well as within a rectangular groove in bogie wheel 156.

Bogie wheels 146 and 156 are shown assembled together in threaded engagement with track members 140 and 142, respectively, by way of fasteners 203 and 291, respectively. Fastener 203 passes through a bearing retainer 209 before engaging with an inner race of bearing 296. Likewise, fastener 291 passes through a bearing retainer 290 which seats against an inner race of bearing 298. Fasteners 203 and 291 are received in threaded engagement within a respective complementary threaded bore within track members 140 and 142, respectively.

Also shown in FIG. 13, fastener 202 passes through a drive wheel retainer 208 before being threaded into a complementary, threaded female bore within idler shaft 100. Likewise, fastener 274 passes through a drive wheel retainer 288 before being received in threaded engagement within a complementary, threaded female bore within drive shaft 102.

As shown in FIG. 13, sidewall 78 is rigidly affixed onto cross-member 82 to support the associated components of upper drive assembly 42. Likewise, sidewall 84 is rigidly affixed onto cross-member 88 to support associated components of lower drive assembly 44. A cylindrical bearing 116 and 120 is provided within a bearing seat within each of sidewalls 78 and 84, respectively. A bearing retaining ring 293 is provided within a circumferential groove of shafts 100 and 102, respectively, to retain inner races of bearings 116 and 120 therein. A plurality of fasteners 286 are threaded into sidewalls 78 and 84 so as to engage a bearing retaining ring 287 that holds an outer race of each bearing 116 and 120 relative to sidewalls 78 and 84, respectively.

As shown in FIG. 13, fasteners 286 are illustrated in the cross-sectional view, as taken in FIG. 7. However, it is understood that fasteners 286 do hot actually fall within the sectional line 12-12 of FIG. 7. However, fasteners 286 are depicted in this sectional view in order to facilitate an understanding of such bearing assembly. Furthermore, a circumferential groove is provided on the outer bearing race for bearings 116 and 120, into which ring 287 is received.

FIG. 14 illustrates upper drive assembly 42 tilted upward to a raised position, about hinge 98. Such raised configuration facilitates maintenance and cleaning between upper drive assembly 42 and lower drive assembly 44. Furthermore, the ability for upper drive assembly 42 to pivot upwardly as relatively large objects are engaged between wheels 58 and 60, as well as belts 70 and 72, tends to reduce any malfunctioning during operation. This feature accommodates the bunching of open neck portions of plastic bags (which increases thickness) during processing therebetween.

Another reason for providing pivotal separation between bands 70 and 72, as well as rings 62 and 64, results because bunching of open neck portions on a plastic bag can cause transverse stresses (perpendicular to the direction of travel) as a leading edge and a trailing edge of a bag are bunched towards the center portion of the bag, which tends to cause rotational and lateral shifting of plastic within the open neck portion of the bag relative to adjacent portions of the bag. By providing a cylindrical cross-sectional configuration (i.e., omitting any sharp edges) on bands 70, 72 and rings 62, 64, compliance can be provided between such co-acting surfaces which enables transverse slippage of plastic material of an open neck portion of a bag to accommodate such transverse stresses. Furthermore, pivotal motion of upper drive assembly 42 about hinge 98 further facilitates such transverse shifting as the bag is pulled and stressed in order to impart alignment as the bag open neck portion is bunched therebetween.

Also shown in FIG. 14, covers 92 and 94 have inclined adjacent sides to facilitate pivotal raising of assembly 42 relative to assembly 44 without imparting contact between covers 92 and 94. Additional details and numbered features in FIG. 14 correspond with those previously depicted with reference to FIG. 13.

Figure 15:
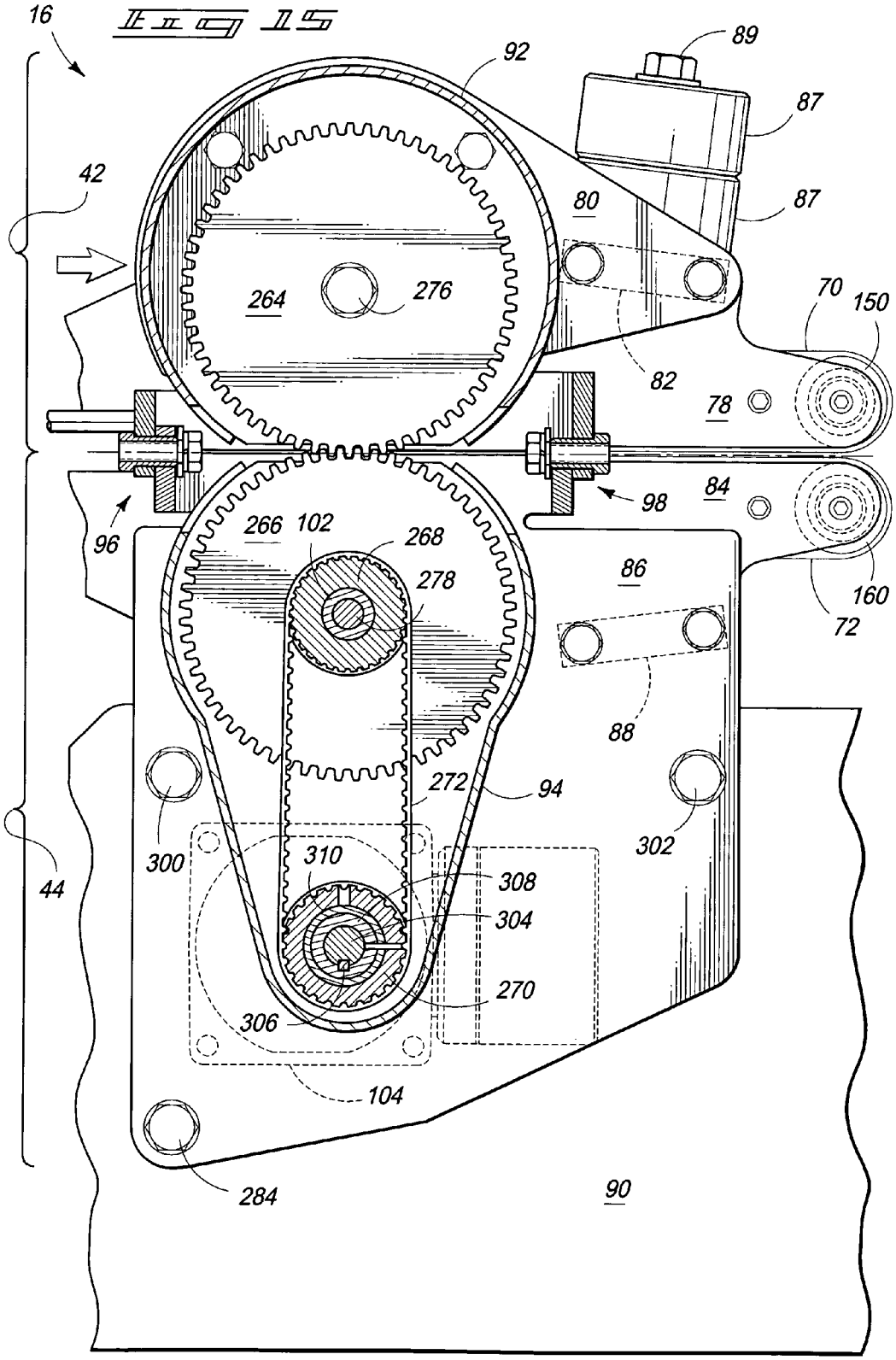
FIG. 15 is a sectional view taken along 15-15 of FIG. 12 and illustrating drive mechanisms between the motor and the upper and lower drive assemblies for the bag accumulating device of FIGS. 1-6.
Figures 11, 12, 13:
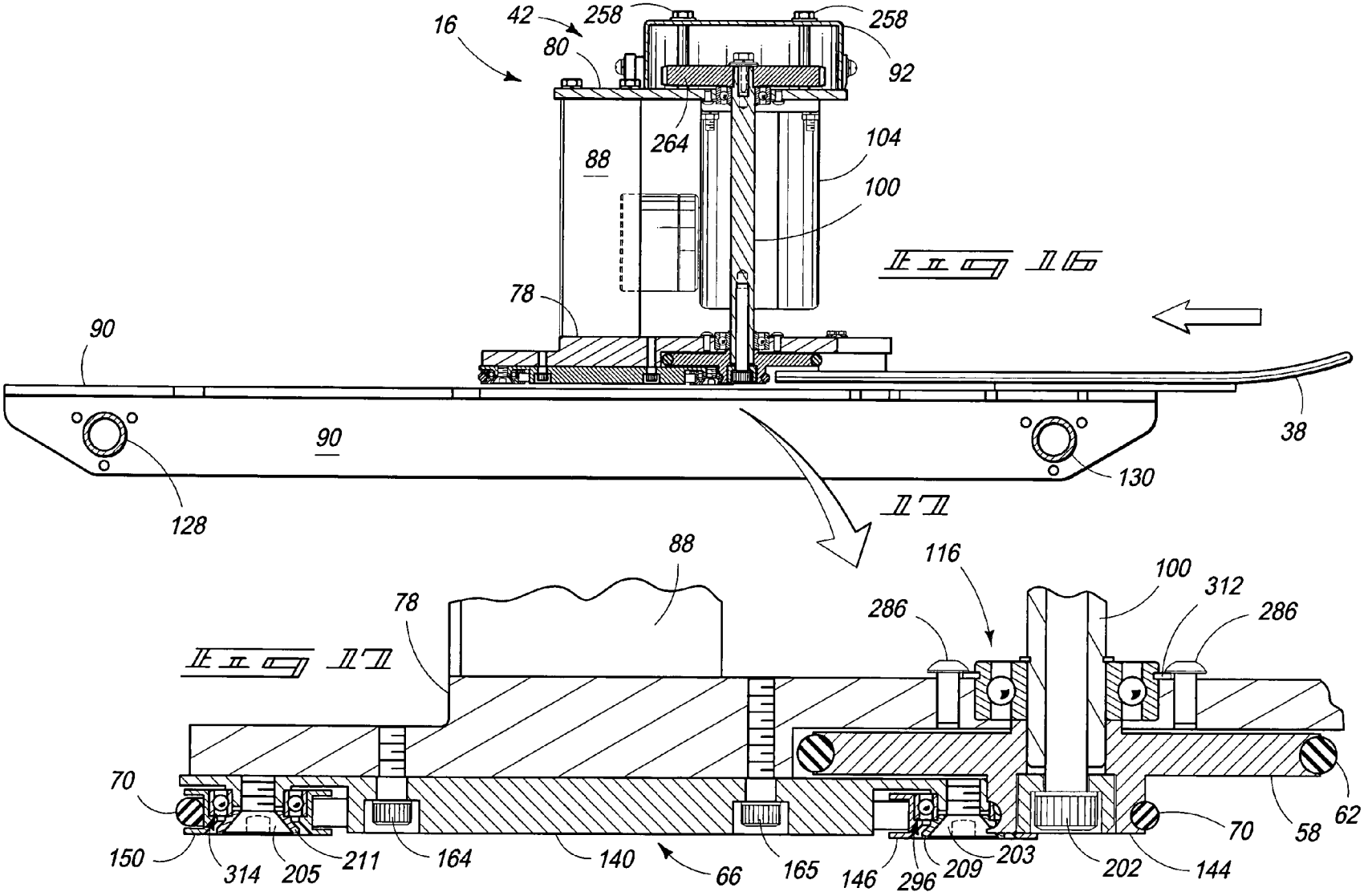
Figure 11:
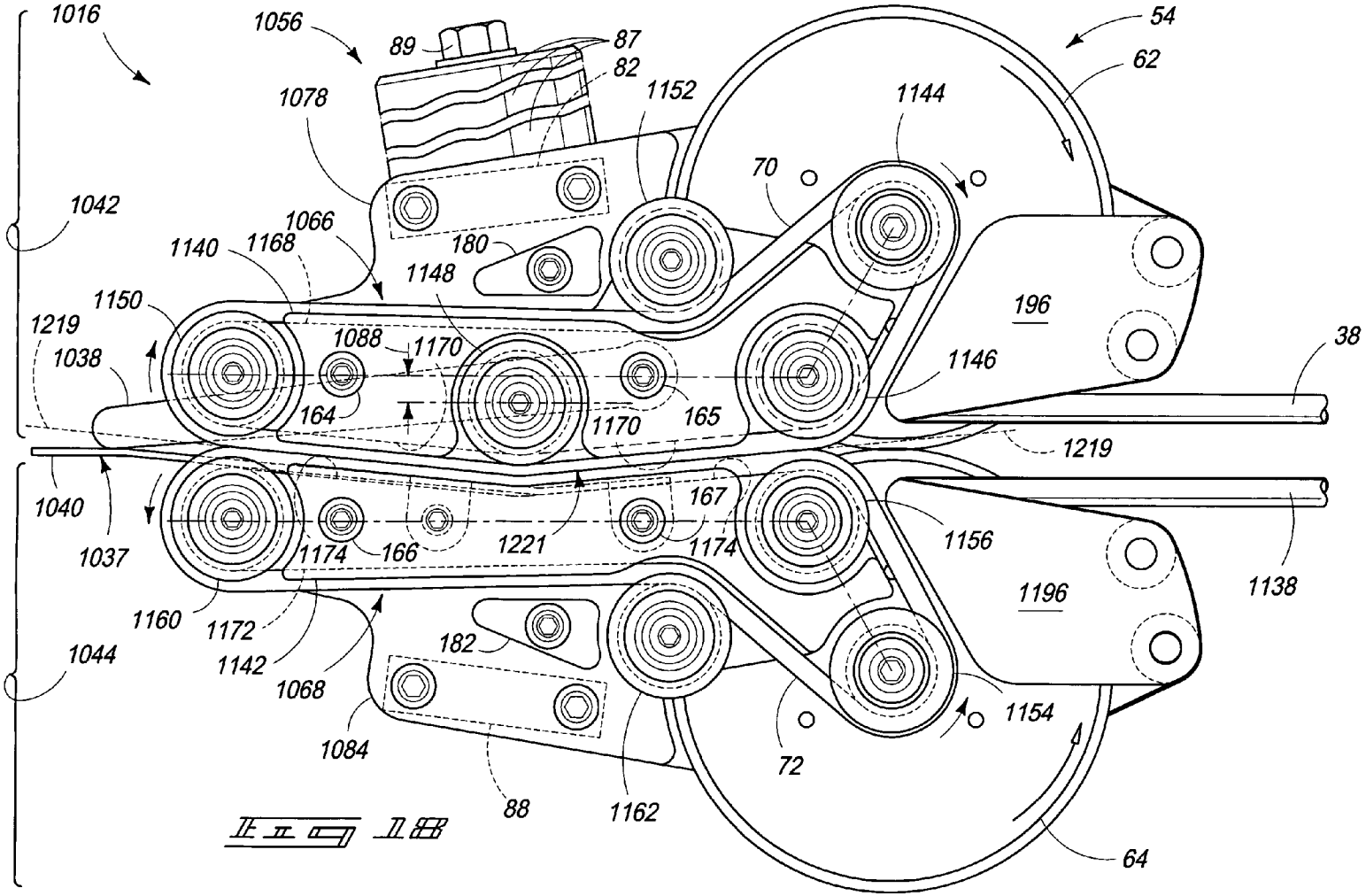

FIG. 15 illustrates construction of the drive mechanism used to drive wheel drive mechanism 54 and track drive mechanism 56 (see FIG. 12) in: counter-rotation. More particularly, upper drive assembly 42 of bag accumulating device 16 is driven by rotation of gear 264 which is affixed to a respective idler shaft via a threaded fastener (or bolt) 276. Gear 264 is driven in counter-rotation by intermeshing with teeth on gear 266 of lower drive assembly 44. Motor 104 drives a motor shaft 304 in rotation. Grooved pulley 270 is affixed onto shaft 304 via a key 306; and a pair of intermeshed slit bushings 308 and 310. Grooved pulley 270 meshes with toothed drive belt (or timing belt) 272 to co-rotate grooved pulley 268. Grooved pulley 268 is fixedly mounted onto gear 266 via a bushing 102 and fastener 278. Accordingly, rotation of grooved pulley 268 rotates gear 266 in unison.

Also shown in FIG. 15, hinges 96 and 98 enable upward pivoting of upper drive assembly 42 relative to lower drive assembly 44. As this occurs, gears 264 and 266 pivot with respect to one another, as shown previously in FIG. 14.

Additionally, fasteners 284, 300 and 302 are provided in sidewall 86 to secure into respective mounting plate spacers 108 and 107, 106 (see FIG. 12). Covers 92 and 94 are shown to follow the general contour of gears 264 and 266, along with belt 272. Additionally, sidewalls 78, 80 and 84, 86 are also depicted in FIG. 15. Sidewalls 78 and 80 are affixed together via cross-member 82, whereas sidewalls 84 and 86 are affixed together via cross-member 88.

Furthermore, bands 70 and 72, as well as respective bogie wheels 150 and 160, are shown at a downstream end of the upper drive assembly 42 and lower drive assembly 44. Even furthermore, weights 87 are shown affixed via fastener 89 onto cross-member 82 for adjusting the downward pivotal gravitational force used to engage together assemblies 42 and 44.

FIG. 16 illustrates further construction details of bag accumulating device 16 as viewed along sectional line 16-16 of FIG. 7. More particularly, the assembly of sidewalls 78 and 80 via cross-member 88 forms a framework for upper drive assembly 42. Device 16 is mounted onto mounting plate 90, which is further adjustably positioned at desired vertical locations along guide rods (not shown) via bushings 128 and 130. The orientation of threaded fasteners 258 is also shown for holding cover 92 onto side plate 80. Furthermore, a sectional view is shown of gear 264 and idler shaft 100, in relation to drive motor 104.

FIG. 17 illustrates in enlarged partial perspective view a portion of FIG. 16 showing construction details of top track assembly 66 including track member 140 and sidewall 78. Sidewall 78 is shown affixed at one end to cross-member 88. Track member 140 is shown secured via threaded fasteners 164 and 165 and threaded bores to sidewall 78. Bearing 116 is shown inserted into a recess within sidewall 78 where bearing 116 is secured via a bearing retainer ring 312 with a plurality of threaded fasteners 286 to sidewall 78. A plurality of circumferentially spaced apart threaded fasteners 286 are provided around bearing 116 for securing bearing 116 to sidewall 78. As shown in FIG. 17, fasteners 286 do not actuary lie within the section taken in FIG. 17. However, they are shown here in sectional view in order to facilitate description of the bearing assembly. Instead, three fasteners 286 are actually used at the positions depicted by threaded bores 230-232 in FIG. 10.

FIG. 17 further illustrates the mounting of wheels 58 and 144 via threaded fastener 202 onto shaft 100 for rotation via bearing 116. Frictionable O-ring 62 is provided about drive wheel 58 whereas frictionable band 70 encompasses a portion of drive wheel 144. Bogie wheel 146 is shown mounted for rotation on cylindrical bearing 296, which is secured into position using a threaded fastener 203 and bearing retainer 209 to mount bogie wheel 146 and bearing 296 onto track member 140. Similarly, bogie wheel 150 is carried for rotation about a cylindrical bearing 314 on track member 140. More particularly, a threaded fastener 205 cooperates with a bearing retainer 211 to secure bogie wheel 150 and bearing 314 onto track member 140.

FIGS. 18 and 19 illustrate a recently developed alternative embodiment of the present invention and comprise modifications to the embodiment depicted in FIGS. 1-17. More particularly, FIG. 18 corresponds with FIG. 8 of the previous embodiment. FIG. 19 further illustrates the embodiment depicted in FIG. 18.

FIG. 18 illustrates a recently developed alternative construction that provides further enhanced performance over the construction depicted in FIGS. 1-17. Bag accumulating device 1016 is essentially the same as bag accumulating device 16 of FIGS. 1-17. However, modifications have been made to track drive mechanism 1056; namely, top track assembly 1066 and bottom track assembly 1068 are modified versions of tracks 66 and 68 (see FIG. 8), respectively. Furthermore, guide bar 1138 differs from guide bar 40 (of FIG. 8). An additional difference is provided by the addition of a bag guide system 1037 including a pivotal upper guide bar 1038 and a lower guide bracket 1040. Additionally, sidewalls 1078 and 1084 are virtually identical to sidewalls 78 and 84 (see FIG. 8), with the exception that additional fastener holes are provided on an inner surface of sidewalls 1078 and 1084 for securing guide bar 1038 and guide bracket 1040, respectively, thereto. Remaining construction details of bag accumulating device 1016 are identical to those depicted for bag accumulating device 16 (of FIGS. 1-17). For example, cross-members 82 and 88, safety guides 180 and 182, wheel drive mechanism 54 and guide bar 38 are each identical to the respective components of the bag accumulating device 16 of FIGS. 1-17.

As shown in FIG. 18, track drive mechanism 56 provides even further improved bunching of an open neck portion of a plastic bag as well as conveying of the bunched open neck portion of the bag between bands 70 and 72. More particularly, bands 70 and 72 are each rotated about a circuitous path that differs over the paths depicted in FIG. 8. More particularly, top track assembly 1066 includes a single, intermediate bogie wheel 1148 that is disposed downwardly a substantial displacement distance 1088 relative to bogie wheels 1146 and 1150. Band 70 is carried across bogie wheels 1146, 1148 and 1150 in a V-shaped groove 1170 provided within track member 1140. Track member 1142 of bottom track assembly 1068 forms a complementary V-shaped interface as band 72 travels between bogie wheels 1156 and 1160, within a complementary V-shaped groove 1174 provided within track member 1142. Grooves 1170 and 1174 cooperate with laterally displaced bogie wheel 1148 to form a V-shaped track 1219 to provide a V-shaped elongated contact section 1221 between bands 70 and 72. Accordingly, contact section 1221 forms an obtuse angle that is less than 180 degrees.

In recent prototype testing, it has been found that the lateral displacement of bogie wheel 1148 and the provision of V-shaped contact section 1221 enhance the ability for drive wheels 62 and 64 to deliver an open neck portion of a plastic bag at a relatively high speed into and between bands 70 and 72 which travel at a substantially lower speed in order to bunch the open neck portion of the bag between bands 70 and 72. Additionally, bands 70 and 72 have been found to more effectively deliver the bunched-up open neck portion of a bag along the V-shaped track 1219. The bag then exits from between bogie wheels 1150 and 1160 for delivery between bar 1038 and bracket 1040 into a bag closing device for applying a clip to the bunched-up open neck portion of a plastic bag.

As shown in FIG. 18, a pair of threaded fasteners 164 and 165 secure track member 1140 onto sidewall 1078. Likewise, a pair of threaded fasteners 166 and 167 secure track member 1142 onto sidewall 1084.

In order to further define a circuitous rotating path for band 70, bogie wheel 1152 ensures passage of band 70 within groove 1168. Likewise, bogie wheel 1162 ensures passage of band 72 within groove 1172.

Also according to FIG. 18, drive wheel 1148 is integrally formed with drive wheel 62. Likewise, drive wheel 1154 is integrally formed with drive wheel 64. As was the case with the embodiment depicted in FIG. 8, drive wheels 62 and 64 each include an O-ring on the outer circumferential surface of the respective wheel. Accordingly, FIG. 18 illustrates modifications to the upper drive assembly 42 and the lower drive assembly 44 which can be incorporated onto the remaining construction features depicted in the embodiment of FIGS. 1-17. For example, lower guide bar 1138 replaces the guide bar depicted in the embodiment of FIG. 8. More particularly, guide bar 1138 is identical to upper guide bar 38, but is a mirror image thereof. Guide bar 1138 includes a guide bracket 1196, similar to guide bracket 196. Guide bracket 1196 is assembled in an identical manner to guide bracket 196 onto sidewall 1084, as previously discussed with regard to the construction depicted in FIGS. 1-17. Furthermore, guide bar 1138, in contrast with guide bar 40 (see FIG. 6), does not attach to the sidewall on the conveyor table.

According to one construction, the simplified drawings of FIGS. 18 and 19 (as well as FIGS. 1-17) are drawn essentially to scale wherein one suitable center distance between bogie wheels 1146 and 1150 is 5¼ inches. According to such one suitable construction, wheels 62 and 64 are driven at a final output of 288 revolutions per minute (RPM), when the drive gear motor has a drive output of 360 revolutions per minute (RPM). Also according to such construction, one exemplary tangential (or linear) speed on the outer surface of drive wheels 62 and 64 is 60.45 inches per second, while bands 70 and 72 are concurrently driven at 11.8 inches per second. Accordingly, the ratio between the tangential contact speed of wheels 62 and 64 and the contact speed between bands 70 and 72 is 3.342. However, it is understood that any of a number of alternative operating speeds, ratios, and scales can be utilized according to the present invention as long as the delivery speed of the first feed mechanism exceeds that of the second feed mechanism.

FIG. 19 illustrates features for the bag guide system 1037 that is provided at a downstream end of bag accumulating device 1016. More particularly, guide bar 1038 is pivotally supported by a threaded fastener 1500 for rotation. Preferably, guide bar 1038 is formed from a relatively thick piece of aluminum material so that the weight of guide bar 1038 downwardly biases guide bar 1038 into engagement with guide bracket 1040. As a bunched-up open neck portion of a bag is delivered therebetween, guide bar 1038 cooperates with guide bracket 1040 to maintain the bunched-up open neck portion of the bag in an accumulated, or pleated, configuration as the bag is delivered into a closing machine.

Guide bar 1038 is pivotally supported by passing fastener 1050 through a lock washer 1502, a washer 1504, a bore through guide bar 1038, a bore through bushing 1506 and into a threaded bore (not shown) within sidewall 1078, similar to threaded bore 1520. By adjusting the tightness of threaded fastener 1500, pivotal friction on guide bar 1038 can be adjusted or eliminated which can vary the downward pressure of guide bar 1038 acting against guide bracket 1040

Guide bracket 1040 is affixed to an inner face of sidewall 1084 using a pair of threaded fasteners 1508 and 1514. Each fastener 1508 and 1514 passes through a washer 1510 and 1516 and a mounting flange 1512 and 1518, respectively, before passing into threaded bores (not shown) provided within sidewall 1084. Preferably, the pair of threaded bores in sidewall 1084 provided for fasteners 1508 and 1514 are in an identical mirror image position with the threaded bores provided within sidewall 1078 (such as bore 1520). By providing such a mirror image configuration, sidewalls 1078 and 1084 can be used interchangeably when making a left-hand or a right-hand version of the present invention. For example, one product packaging system may require a left-hand machine, whereas another product packaging system may require a right-hand machine. Accordingly, it is envisioned that bag fastening system 10 of FIG. 1 can also be constructed in a mirror image configuration where the construction of FIG. 1 is a right-hand system and the mirror image construction is a left-hand system. However, such a construction would create an unnecessary amount of inventoried parts. By providing for interchangeability of some parts, the inventory requirements will be significantly reduced.

Also shown in FIG. 19, guide bars 38 and 1038 are shown at an upstream end of bag accumulating device 1016 for guiding an open neck portion of a bag therebetween for delivery between wheels 62 and 64. As the open neck portion of the bag is bunched up between bands 70 and 72, the bunched-up open neck portion of a bag is then delivered downstream between bar 1038 and bracket 1040. As the bunched-up open neck portion of the bag passes between bands 70 and 72 and out from between bogie wheels 1050 and 1060, guide bar 1038 and bracket 1040 further cooperate to maintain the accumulated or bunched-up open neck portion of the bag as the bag is delivered into a bag closing machine for the application of a bag closer or fastener.

As shown in the construction depicted in FIGS. 18 and 19, a total of three corrector weights 87 are mounted with a fastener 89 onto cross-member 82, as shown in FIG. 19. It has been found that any of a number of corrector weights can be utilized. However, according to one construction, three corrector weights have been found to be effective where each corrector weight weighs one pound.

Although devices 14, 16, and 18 of FIG. 1 are configured to receive an open neck portion of a bag in a horizontal plane, devices 14, 16, and 18 can be mounted at a different orientation alongside conveyor table 12 in order to apply clips onto bags that are conveyed in a different orientation. For example, bag fastening system 10 can be modified in order to apply clips onto bags of articles of fruit, such as apples. In order to achieve such a result, devices 14, 16, and 18 can be mounted onto a plate that is supported by mounting assembly 22 by way of a hinge and a support strut The plate is configured to be repositioned from a vertical position that is nested in parallel with plate 90 (see FIG. 6) to a position that is perpendicular, or 90 degrees, to plate 90. In this manner, devices 14, 16, and 18 can be configured to receive an open neck portion of a bag in a vertical plane (or any other plane between horizontal and vertical). Accordingly, when applying a clip onto a bag of apples, the bag can be supported at a bottom, with the clip being applied to the top portion of the bag via devices 14, 16, and 18 which accept the open neck portion of a bag in a vertical plane.

In operation, a method is provided for bunching an open mouth of a plastic bag. The method includes providing a first feed mechanism and a second feed mechanism downstream and adjacent to the first feed mechanism. The open neck portion of the bag is delivered into the first feed mechanism. The open neck portion of the bag is passed through the first feed mechanism at a first velocity. The open neck portion of the bag is received from the first feed mechanism into the second feed mechanism. The open neck portion of the bag is accumulated in the second feed mechanism by moving the second feed mechanism at a second velocity below the velocity of the first feed mechanism to bunch up the open neck portion of the bag. After the open neck portion of the bag is accumulated, the open neck portion of the bag is delivered from the second feed mechanism to a bag closing device to close the bunched-up open neck portion of the bag.

In compliance with the statute, the invention has been described in language more or less specific as to structural and methodical features. It is to be understood, however, that the invention is not limited to the specific features shown and described, since the means herein disclosed comprise preferred forms of putting the invention into effect. The invention is, therefore, claimed in any of its forms or modifications within the proper scope of the appended claims appropriately interpreted in accordance with the doctrine of equivalents.

The invention claimed is:

1. A bag neck accumulating device for flexible plastic bags, comprising:

a conveyor belt configured to move a sequential array of plastic bags each containing one or more articles supported for movement in a substantially horizontal plane along an article travel path that presents an open-mouth portion of each bag in a substantially horizontal plane;

a lower drive unit;

an upper drive unit supported in floating relation atop the lower drive unit;

a first drive mechanism provided by the upper drive unit and the lower drive unit and configured along a laterally constrained course spaced from the conveyor belt along a bag neck travel path, provided laterally of the article travel path and configured to advance the substantially horizontal open-mouth portion of a bag at a first speed; and a second drive mechanism provided by the upper drive unit and the lower drive unit and configured along the laterally constrained course provided along the bag neck travel path adjacent and downstream of the first drive mechanism and configured to advance the open-mouth portion of the bag at a second speed less than the first speed so as to accumulate and foreshorten the open-mouth portion of the bag;

wherein the upper drive unit is pivotally affixed to the lower drive unit via a hinge such that during an operating state of the device while accumulating bag necks a top portion of the first drive mechanism and the second drive mechanism can be separated from a bottom portion of the first drive mechanism and the second drive mechanism by pivoting the upper drive unit upwardly away from the lower drive unit about the hinge while the open-mouth portion of each bag passes therethrough.

2. The bag neck accumulating device of claim 1 wherein the first drive mechanism comprises a pair of co-acting drive wheels positioned above and below the open-mouth portion of a bag and driven in counter-rotation to advance the open-mouth portion of the bag at the first speed into the second drive mechanism.

3. The bag neck accumulating device of claim 2 wherein each drive wheel comprises a cylindrical wheel having a radial outermost ring portion comprising a frictionable elastic material configured to engage with the open-mouth portion of a bag.

4. The bag neck accumulating device of claim 1 wherein the second mechanism comprises a pair of co-acting band track assemblies including a pair of co-acting bands configured to be driven in counter-rotation and between which an open-mouth portion of a bag is accumulated and foreshortened relative to the first drive mechanism which advances the open-mouth portion of a bag at a higher, first operating speed than the second drive mechanism.

5. The bag neck accumulating device of claim 4 wherein each band track assembly comprises a flexible band driven for rotation in a circuit and formed from a frictionable material that grips an advancing open-mouth portion of a bag.

6. The bag neck accumulating device of claim 5 wherein the band comprises a closed-loop track, and further comprising a plurality of bogie wheels supported by a frame and configured to support an inside perimeter of the band to keep the band aligned along the circuitous path.

7. The bag neck accumulating device of claim 6 wherein one of the bogie wheels comprises a drive wheel driven in conjunction with the first drive mechanism to drive the band in circuitous motion about the bogie wheels, and another of the bogie wheels is offset from a linear travel path along a contact portion of the closed-loop track to provide a v-shaped travel path between the pair of co-acting bands.

8. The bag neck accumulating device of claim 1 wherein the upper drive unit comprises a drive shaft configured at one end to drive a top portion of the first drive mechanism and a top portion of the second drive mechanism, and a drive gear provided at an opposite end of the drive shaft, and the lower drive unit comprises a drive shaft configured to drive a lower portion of the first drive mechanism and a lower portion of the second drive mechanism, and a drive gear at the opposite end of the drive shaft configured to communicate in counter-rotation with the drive gear of the upper drive unit to drive the respective drive shafts in counter-rotation.

9. The bag neck accumulating device of claim 8 further comprising a drive motor with a drive gear configured to drive the respective gears on the upper drive unit and the lower drive unit and drive top portions of the first drive mechanism and the second drive mechanism in counter-rotation with the bottom portions of the first drive mechanism and the second drive mechanism.

10. The bag neck accumulating device of claim 1 wherein the upper drive unit is pivotally engaged against the lower drive unit via gravitational attraction.

11. The bag neck accumulating device of claim 1 further comprising at least one guide bar configured to guide an open-mouth portion of a bag into the first drive mechanism and the second drive mechanism.

12. A bag neck gathering machine, comprising:

a lower drive unit;

an upper drive unit pivotally supported in floating relation atop the lower drive unit for engagement together via gravitational attraction of the upper drive unit towards the lower drive unit and separation apart via an articulating drive connection that maintains coupling of the drive connection as the upper drive unit is pivoted relative to the lower drive unit during passage of open-mouth portions of bags between the lower drive unit and the upper drive unit;

a first drive mechanism provided between the lower drive unit and the upper drive unit and configured to move an open neck of a plastic bag along a travel path at a first speed; and a second drive mechanism provided between the lower drive unit and the upper drive unit and configured to move the open neck of the plastic bag along the travel path at a second speed below that of the first speed so as to bunch up the neck of the plastic bag between the pair of bands for delivery into a bag closing machine.

13. The bag neck gathering machine of claim 12 wherein the first drive mechanism comprises a pair of co-acting rotating feed wheels, and the feed wheels each comprise a rigid cylindrical wheel having a resilient and frictionable outer ring configured to co-act with an open neck of a plastic bag to grip and move the bag.

14. The bag neck gathering machine of claim 13 wherein the ring comprises a band of resilient synthetic rubber material.

15. The bag neck gathering machine of claim 12 wherein the second drive mechanism comprises a pair of co-acting rotating endless bands having a non-linear contact track provided adjacent and downstream of the first drive mechanism, and further comprising a support track for each of the pair of bands configured to support each band for rotation and provide an elongated contact section on one band that is urged against a respective contact section on another band to bunch up the neck of a plastic bag therebetween.

16. The bag neck gathering machine of claim 15 wherein each support track comprises a plurality of bogie wheels configured to support the band for rotation about the support track and along the elongated contact section.

17. The bag neck gathering machine of claim 16 wherein a first bogie wheel is provided at an upstream end of the elongated contact section and a second bogie wheel is provided at a downstream end of the elongated contact section.

18. The bag neck gathering machine of claim 17 wherein, for at least one of the support tracks, a third bogie wheel is provided intermediate the first bogie wheel and the second bogie wheel, along the elongated contact section, and wherein the third bogie wheel is offset from the first bogie wheel and the second bogie wheel so as to displace the band from being linearly aligned between the first bogie wheel and the second bogie wheel.

19. The bag neck gathering machine of claim 18 wherein both support tracks include a third bogie wheel, wherein the third bogie wheel of a first one of the support tracks is positioned upstream from the third bogie wheel of a second of the pair of support tracks, and wherein each of the respective third bogie wheels imparts contact interference between the respective bands to further ensure bunching of the neck of a plastic bag between the pair of bands.

20. The bag neck gathering machine of claim 19 wherein the offset third bogie wheels impart a zigzag contact interface between the pair of co-acting endless bands, along the elongated contact section.

21. The bag neck gathering machine of claim 15 wherein the pair of co-acting rotating endless bands engage along an elongated contact section with an interference fit.

22. The bag neck gathering machine of claim 15 further comprising a pair of drive wheels each configured to drive a respective one of the pair of bands.

23. The bag neck gathering machine of claim 22 wherein each drive wheel is driven in co-rotation with a respective one of the feed wheels.

24. A bag neck gathering machine, comprising:

a conveyor for moving a series of bags each with at least one article along a first travel path;

a first feed mechanism for moving an open neck portion of a bag at a first rate along a second travel path spaced laterally of the first travel path;

a second feed mechanism proximate and downstream of the first feed mechanism for moving the open neck portion of the bag at a second rate less than the first rate to gather together at least in part the open neck portion of the bag; and a floating drive mechanism having a lower drive unit and an upper drive unit supported in generally vertical floating relation atop the lower drive unit, the floating drive mechanism provided by the first feed mechanism and the second feed mechanism for engaging through gravitational attraction and disengaging against gravitational attraction bag contact portions of the first means feed mechanism and the second feed mechanism while open-mouth portions of bags pass between the portions of the first feed mechanism and the second feed mechanism.

25. The machine of claim 24 wherein the floating drive mechanism further comprises a hinge provided laterally of a contact region between the upper drive unit and the lower drive unit configured to pivotally support the upper drive unit in floating relation atop the lower drive unit.

26. The machine of claim 25 wherein the first feed mechanism comprises a pair of counter-rotating feed wheels and the second feed mechanism comprises a pair of counter-rotating endless bands, and further comprising at least one drive motor configured to drive the counter-rotating feed wheels and the counter-rotating endless bands.

27. The machine of claim 26 wherein the counter-rotating endless bands mate together along a contact section in which the open neck portion of the bag is gathered together and delivered downstream to a bag closing machine.

* * * * *

UNITED STATES PATENT AND TRADEMARK OFFICE

CERTIFICATE OF CORRECTION

PATENT NO. : 8,474,227 B2
APPLICATION NO. : 10/835327
DATED : July 2, 2013
INVENTOR(S) : Jere F. Irwin It is certified that error appears in the above-identified patent and that said Letters Patent is hereby corrected as shown below:

In the Specification

Column 5, line 25 – Replace "station of" with --rotation of--

Column 15, line 41 – Replace "object To" with --object. To--

Column 17, line 32 – Replace "do hot actually" with --do not actually--

Column 21, line 5 – Replace "bracket 1040" with --bracket 1040.--

Column 21, line 57 – Replace "strut The plate" with --strut. The plate--

Signed and Sealed this
Thirty-first Day of December, 2013

Margaret A. Focarino

Margaret A. Focarino
*Commissioner for Patents of the United States Patent and Trademark Office*